US009425495B2

(12) United States Patent
Walker

(10) Patent No.: US 9,425,495 B2
(45) Date of Patent: Aug. 23, 2016

(54) ACTIVE ANTENNA CEILING TILE

(71) Applicant: Michael Clyde Walker, Coronado, CA (US)

(72) Inventor: Michael Clyde Walker, Coronado, CA (US)

( * ) Notice: Subject to any disclaimer, the term of this patent is extended or adjusted under 35 U.S.C. 154(b) by 69 days.

(21) Appl. No.: 14/168,493

(22) Filed: Jan. 30, 2014

(65) Prior Publication Data

US 2014/0218258 A1 Aug. 7, 2014

Related U.S. Application Data

(60) Provisional application No. 61/759,968, filed on Feb. 1, 2013.

(51) Int. Cl.

| | |
|---|---|
| ***H01Q 1/38*** | (2006.01) |
| ***H01Q 1/00*** | (2006.01) |
| ***H01Q 21/20*** | (2006.01) |
| *H01Q 9/26* | (2006.01) |
| *H01Q 19/30* | (2006.01) |

(52) U.S. Cl.

CPC ..... *H01Q 1/007* (2013.01); *H01Q 21/205* (2013.01); *H01Q 9/26* (2013.01); *H01Q 19/30* (2013.01); *Y10T 29/49016* (2015.01)

(58) Field of Classification Search

CPC . H01Q 19/108; H01Q 9/0407; H01Q 19/106
USPC ..... 343/848, 853, 700 MS, 846, 835, 703
See application file for complete search history.

(56) References Cited

U.S. PATENT DOCUMENTS

| | | | | |
|---|---|---|---|---|
| 3,372,572 | A | 3/1968 | Kuo | |
| 4,001,834 | A | 1/1977 | Smith | |
| 5,164,738 | A | 11/1992 | Walter et al. | |
| 5,181,043 | A | 1/1993 | Cooper | |
| 5,414,438 | A | 5/1995 | Dooley | |
| 5,898,405 | A * | 4/1999 | Iwasaki | H01Q 1/38 343/700 MS |
| 6,057,803 | A | 5/2000 | Kane et al. | |
| 6,341,217 | B1 | 1/2002 | Wong | |
| 6,486,847 | B1 * | 11/2002 | Yamamoto et al. | 343/789 |
| 6,563,425 | B2 | 5/2003 | Nicholson et al. | |
| 6,563,465 | B2 | 5/2003 | Frecska | |
| 6,615,026 | B1 | 9/2003 | Wong | |
| 6,715,246 | B1 * | 4/2004 | Frecska | E04B 9/045 181/150 |
| 6,788,256 | B2 * | 9/2004 | Hollister | 343/700 MS |

(Continued)

FOREIGN PATENT DOCUMENTS

WO WO 2014/210519 6/2014

*Primary Examiner* — Peguy Jean Pierre

(74) *Attorney, Agent, or Firm* — IDP Patent Services; Olav M. Underdal

(57) ABSTRACT

An active antenna may be installed within a ceiling of a building to improve the range of a wireless and/or cellular network. Further, a ground plane may be installed throughout the ceiling to reduce the occurrence of multipath interference of radio frequency (RF) signals. In addition, one or more passive antennas may also be installed in the ceiling to further extend the range of the wireless and/or cellular network within the building. Each of the antennas may be designed to facilitate (RF) signal gain for a collection or range of frequencies. In some instances, the installation of active and passive antennas may increase the range of a communications network, while the installation of a ground plane throughout the ceiling may reduce the occurrence on multipath interference resulting in improved wireless and/or cellular network performance including increased bandwidth and range.

20 Claims, 29 Drawing Sheets

(56) References Cited

U.S. PATENT DOCUMENTS

| | | | | |
|---|---|---|---|---|
| 6,809,691 | B2 * | 10/2004 | Yamamoto et al. | 343/702 |
| 6,934,511 | B1 | 8/2005 | Lovinggood et al. | |
| 7,002,523 | B2 | 2/2006 | Noro | |
| 7,065,350 | B2 | 6/2006 | Capobianco et al. | |
| 7,071,886 | B2 | 7/2006 | Doi et al. | |
| 7,088,303 | B1 | 8/2006 | Lackey et al. | |
| 7,146,131 | B2 | 12/2006 | Moon | |
| 7,239,288 | B2 * | 7/2007 | Lynch et al. | 343/833 |
| 7,577,398 | B2 | 8/2009 | Judd et al. | |
| 7,696,940 | B1 | 4/2010 | MacDonald | |
| 7,750,855 | B2 | 7/2010 | Wong | |
| 7,888,630 | B2 | 2/2011 | Wong | |
| 8,208,980 | B2 | 6/2012 | Wong et al. | |
| 8,214,003 | B2 | 7/2012 | Wong et al. | |
| 8,298,318 | B2 | 10/2012 | Wong | |
| 8,442,602 | B2 | 5/2013 | Wong et al. | |
| 8,525,729 | B1 * | 9/2013 | Martin | H01Q 1/38 343/700 MS |
| 8,750,948 | B2 | 6/2014 | Wong et al. | |
| 8,890,101 | B2 * | 11/2014 | Sim | 250/515.1 |
| 8,897,843 | B2 | 11/2014 | Wong et al. | |
| 9,007,272 | B2 * | 4/2015 | Balbien et al. | 343/810 |
| 2007/0152903 | A1 | 7/2007 | Lin et al. | |
| 2007/0205946 | A1 | 9/2007 | Buris et al. | |
| 2008/0001497 | A1 | 1/2008 | Wong et al. | |

* cited by examiner

2400

ACTIVE ANTENNA CEILING TILE

CLAIM OF PRIORITY UNDER 35 U.S.C. §119

This application claims the benefit under 35 U.S.C. §119(e) of U.S. Provisional Patent Application No. 61/759,968, entitled "ACTIVE ANTENNA CEILING TILE," filed Feb. 1, 2013, the entire contents of which are incorporated by reference herein and made part of this specification.

BACKGROUND

1. Field

This disclosure relates to wireless communications. More specifically, this disclosure relates to a distributed antenna system.

2. Description of Related Art

Growing demand for high-rate wireless data services continues to drive the growth of wireless networks. One factor fostering the rapid growth of wireless networks is the growing demand for high-rate data services to be accessible from virtually any location, at all times.

However, despite the efforts of network operators and consumer equipment makers to provide seamless wireless communication coverage, areas of weak signal strength still exist, even in richly serviced areas such as urban centers. The areas of weak signal strength, sometimes referred to as null spots or dead spots, are sometimes caused by the density and material composition of vehicles, buildings and other structures in a wireless coverage area. For example, within a substantially enclosed environment, such as a vehicle or building, the materials of the vehicle or building can cause shadowing, shielding and/or multipath interference that deteriorate radio frequency (RF) signals.

In a vehicle or building, for example, the metal body and/or frame of a vehicle or structural metal and/or reflective windows of a building creates a shielding effect that attenuates radio signals within the vehicle or building. In a dense urban area, the surrounding buildings create a multipath environment where signal reflections destructively combine in locations that are difficult to predict. The destructive interference reduces receivable RF signals to the point where wireless communication can be virtually impossible at the frequency and power levels used in the wireless system. In other situations, the structures themselves act as barriers that significantly attenuate signal strength of RF signals to the point where the RF signal strength within the structure is lower than is desirable for reliable service.

SUMMARY

Various embodiments of systems, methods and devices within the scope of the appended claims have several aspects, no single one of which is solely responsible for the desirable attributes described herein. Without limiting the scope of the appended claims, some features are described. After considering this discussion, and particularly after reading the section entitled "Detailed Description," one will understand how the features of various embodiments are used to configure a passive antenna repeater.

There lies a challenge to provide increased RF signal strength within and around vehicles, buildings and/or other structures, so that wireless data services can be accessed seamlessly throughout a coverage area.

In some embodiments, an active antenna ceiling assembly is disclosed. The active antenna ceiling assembly may include a ground plane structure that includes a plurality of ground plane tiles. Further, the active antenna ceiling assembly may include an active antenna tile. The active antenna tile may include a first dielectric layer and an antenna layer. The antenna layer may include a number of antennas configured to receive and transmit radio frequency (RF) signals. Further, the antenna layer may be disposed on the first dielectric layer. Moreover, the active antenna tile may include a ground plane layer disposed above the antenna layer and in electrical communication with the ground plane.

The antennas of the antenna layer may include a variety of antenna designs. For example, the antennas of the antenna layer may include log periodic antennas, Yagi-Uda antennas, dipole antennas, folded dipole antennas, etc. Further, the antennas of the antenna layer may include one or more of the antenna designs described herein.

Certain embodiments described herein include a method of providing a wireless communication system in a building. The method may include installing a plurality of ground plane tiles in a ceiling of a building, the ground plane tiles installed beneath a set of structures between the ceiling and a floor above the ceiling. Further, the ground plane tiles may be configured to be electromagnetically reflective. Moreover, the method may include joining the plurality of ground plane tiles together in a lateral plane using a conductive joining element to create a ground plane. The method may additionally include installing an active antenna tile in the ceiling. Further, a ground plane layer of the active antenna tile may be positioned within the lateral plane of the plurality of ground plane tiles. In addition, the method may include joining the ground plane layer of the active antenna tile to at least one of the plurality of ground plane tiles thereby including the ground plane layer of the active antenna layer as part of the ground plane.

In some embodiments, an antenna apparatus includes an electromagnetically reflective layer plane, the electromagnetically reflective layer having first and second faces; a first dielectric layer disposed on the first face of the electromagnetically reflective layer; and a first arrangement of conductors disposed on the first dielectric layer. The first arrangement of conductors can include a first resonator including a first antenna having a respective feed point, a second antenna having a respective feed point, and a first coupling element electrically connecting the respective feed points of the first and second antennas. The first arrangement of conductors can include a first reflector electrically isolated from the first resonator and positioned adjacent to at least one of the first and second antennas. The longitudinal axis of the first reflector can intersect the first coupling element.

In some embodiments, the first and second antennas are folded dipole antennas. The respective feed point for each of the first and second antennas comprises first and second feed terminals. Additionally, the coupling element includes first and second conductive traces, the first conductive trace electrically connecting the respective first feed terminals of the first and second antennas, and the second conductive trace electrically connecting the respective second feed terminals of the first and second antennas. In some embodiments, at least one of the first and second antennas includes an undulating portion.

In some embodiments, the first arrangement of conductors also includes a second reflector electrically isolated from the first resonator and positioned adjacent to the second antenna. The longitudinal axis of the second reflector can intersect the first coupling element. In that embodiment, the first reflector is positioned adjacent to the first antenna.

In some embodiments, the antenna apparatus includes a second dielectric layer disposed on the second face of the electromagnetically reflective layer; and a second arrangement of conductors disposed on the second dielectric layer. The second arrangement of conductors includes a second resonator including a third antenna having a respective feed point, a third antenna having a respective feed point, and a second coupling element electrically connecting the respective feed points of the third and fourth antennas; and a second reflector electrically isolated from the second resonator and positioned adjacent to at least one of the third and fourth antennas, and wherein the longitudinal axis of the second reflector intersects the second coupling element.

In some embodiments, the antenna apparatus includes a conductive via extending through the first dielectric layer, the electromagnetically reflective layer and the second dielectric layer, the conductive via electrically connecting the first and second coupling elements; and a dielectric separator interposed between the electromagnetically reflective layer and the via electrically isolating the electromagnetically reflective layer and the via.

One aspect of the disclosure is an antenna apparatus including an electromagnetically reflective layer; a dielectric layer on the electromagnetically reflective layer; a plurality of antennas arranged on the dielectric layer in a respective plurality of directions, each of the plurality of antennas having a feed point; at least one coupling element, wherein each coupling element electrically connects the respective feed points of a respective pair of antennas; and at least one reflector electrically isolated from the plurality of antennas and positioned adjacent to at least one of the plurality of antennas, and wherein the respective longitudinal axis of at least one reflector intersects the first coupling element.

In some embodiments, each of the plurality of antennas is a folded dipole antenna, and the respective feed point for each antenna comprises first and second feed terminals, and wherein each coupling element includes first and second conductive traces, the first conductive trace electrically connecting the respective first feed terminals of a pair of antennas, and the second conductive trace electrically connecting the respective second feed terminals of the same pair of antennas.

Figure 1A:
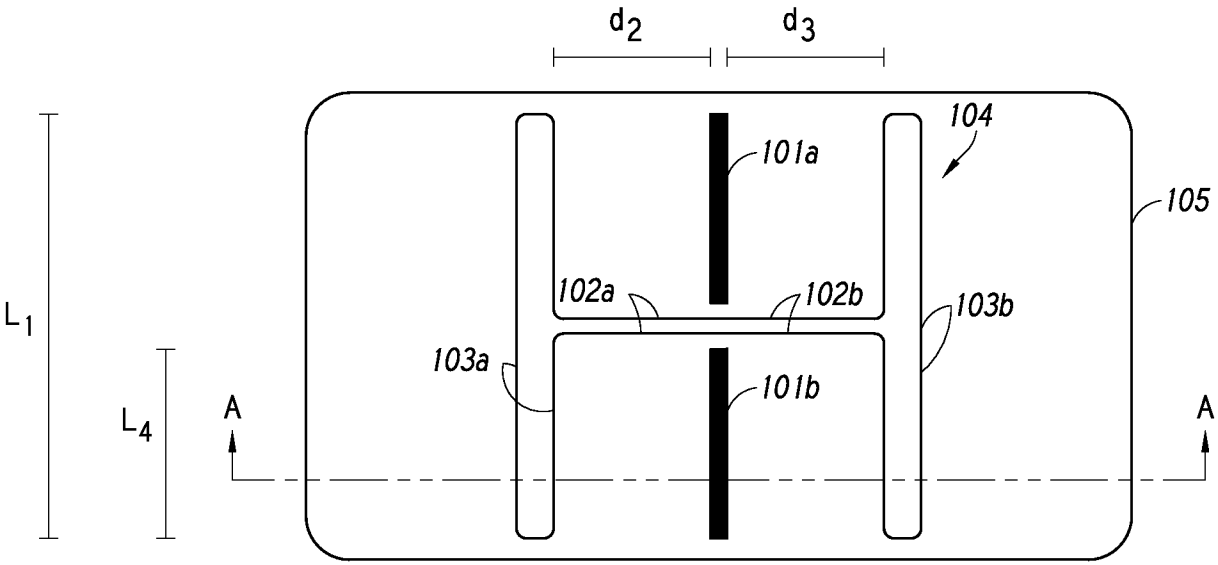
FIG. 1A is a plan view of one embodiment of an antenna apparatus.

The various features illustrated in the drawings may not be drawn to scale. Accordingly, the dimensions of the various features may be arbitrarily expanded or reduced for clarity. In addition, some of the drawings may not depict all of the components of a given system, method or apparatus.

Finally, like reference numerals may be used to denote like features throughout the specification and figures.

DETAILED DESCRIPTION

Various aspects of embodiments within the scope of the appended claims are described below. It should be apparent that the aspects described herein may be embodied in a wide variety of forms and that any specific structure and/or function described herein is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

Some embodiments provide a relatively small antenna apparatus that acts as a passive repeater. The antenna apparatus can be designed to facilitate radio frequency (RF) signal gain for a collection or range of frequencies. Some embodiments are configured to be used with mobile phone networks (e.g., networks operating at 1.920 GHz or other frequencies), wireless data networks (e.g., Wi-Fi networks operating at 2.4 GHz and/or 5.8 GHz), other frequencies, or combinations of frequencies. In some embodiments, the antenna apparatus is placed within a short range, such as, for example, a distance of about 6-24 inches, of a device with a wireless receiver and/or transmitter, where the antenna apparatus causes increased RF signal intensity at the device by coupling RF signals from a proximate area of higher RF signal intensity into the area around the device. Other configurations and ranges are possible, and, in some embodiments, increased RF signal intensity can extend over larger distances. Accordingly, in some instances, an embodiment of the antenna apparatus can be used to increase the RF signal intensity in a null spot or dead spot by coupling RF signal energy from an area proximate to the null spot that has higher RF signal intensity.

Figure 1B:
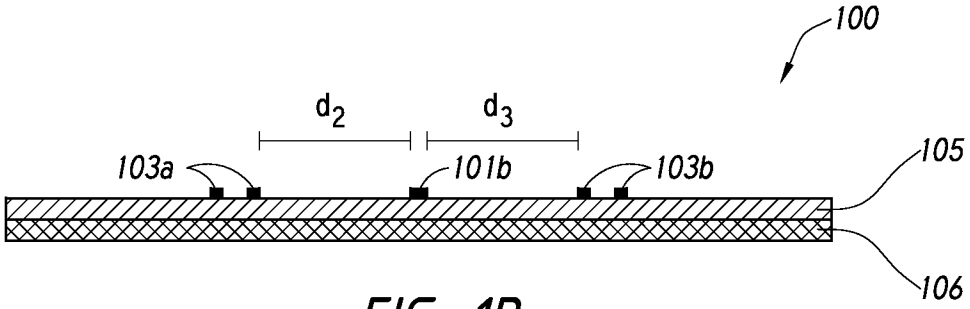
FIG. 1B is a cross-sectional view of the antenna apparatus of FIG. 1A taken along line A-A.

FIG. 1A is a plan view of an antenna apparatus 100, and FIG. 1B is a cross-sectional view of the antenna apparatus 100 in FIG. 1A taken along line A-A. The antenna apparatus 100 illustrated in FIGS. 1A and 1B includes an electromagnetically reflective layer 106, a dielectric layer 105 disposed adjacent to the electromagnetically reflective layer 106, and an arrangement of conductors disposed on the dielectric layer 105. In the illustrated embodiment, the dielectric layer 105 is disposed between the arrangement of conductors and the electromagnetically reflective layer 106. As described in further detail below, the arrangement of conductors includes a resonator 104 and a reflector comprising first and second portions 101*a*, 101*b*.

In some embodiments, the electromagnetically reflective layer 106 includes a rigid conductive plate. For example, the conductive plate can be, without limitation, a plate of aluminum, copper, another metal, a metal alloy, conductive ceramic, a conductive composite material having a thickness sufficient to be substantially rigid, another suitable material, or a combination of materials. In some embodiments, the electromagnetically reflective layer 106 is flexible. For example, the electromagnetically reflective layer 106 can be, without limitation, a plate of aluminum, copper, another metal, a metal alloy, a conductive ceramic and/or a conductive composite material having a thickness sufficient to be substantially flexible. Additionally, the composite material may include a conductive thread including one or more metals and/or metal alloys woven to form a plane or sheet. Additionally and/or alternatively, the electromagnetically reflective layer can be a heterogeneous structure including a combination of dielectric and conductive portions, but nevertheless remaining substantially reflective to electromagnetic energy.

The resonator 104 includes first and second antennas 103*a*, 103*b* electrically connected by a coupling element. For the sake of facilitating the present description only, the coupling element is labeled as having two portions 102*a*, 102*b*. In the antenna apparatus 100, the two portions of the coupling element 102*a*, 102*b* can be arranged so as to be collinear, forming a straight conductive path between the first and second antennas 103*a*, 103*b*.

The reflector includes first and second portions 101*a*, 101*b* separated by a gap through which the coupling element extends and intersects the longitudinal axis of the reflector. In some embodiments, the reflector is a single conductor (not shown), and the antenna apparatus 100 further includes a dielectric separator (not shown) between the reflector and the coupling element. The dielectric separator is provided to electrically isolate the reflector and the coupling element. In other words the dielectric separator prevents the reflector from shorting to the coupling element.

The first and second antennas 103*a*, 103*b* are folded dipole antennas, and the respective feed point of each of the first and second antennas 103*a*, 103*b* includes respective first and second feed terminals. Accordingly, the two portions of the coupling element 102*a*, 102*b* include first and second parallel conductive traces. The first conductive trace electrically connects the respective first feed terminals of the first and second antennas 103*a*, 103*b*. The second conductive trace electrically connects the respective second feed terminals of the first and second antennas 103*a*, 103*b*.

Each of the first and second folded dipole antennas 103*a*, 103*b* is defined by a length $L_1$. The tips of a folded dipole antenna are folded back until they almost meet at the feed point, such that the antenna comprises one entire wavelength. Accordingly, so long as the first and second feed point terminals are sufficiently close to one another, the wavelength of each of the first and second folded dipole antennas 103*a*, 103*b* is $2L_1$. Those skilled in the art will appreciate that this arrangement has a greater bandwidth than a standard half-wave dipole. Moreover, the length of each of the first and second portions of the reflector 101*a*, 101*b* is length $L_4$, which is approximately $\frac{1}{2}L_1$. However, while the first and second reflector portions 101*a*, 101*b* are approximately the same length in FIG. 1A, in other embodiments, the first and second reflector portions 101*a*, 101*b* are different lengths. The lengths of the first and second antennas can be used to determine the dimensions of the antenna apparatus 100.

For example, some embodiments are configured to be used with mobile phone networks (e.g., networks operating at 1.920 GHz or other frequencies), wireless data networks (e.g., Wi-Fi networks operating at 2.4 GHz and/or 5.8 GHz), other frequencies, or combinations of frequencies. As such, the wavelengths associated with such frequencies could be used to define $L_1$, as being a quarter, a half or full wavelength associated with the center frequency of the band.

Additionally, the first folded dipole antenna 103*a* is spaced from the reflector portions 101*a*, 101*b* by a distance $d_2$, and the second folded dipole antenna 103*b* is spaced from the reflector portions 101*a*, 101*b* by a distance $d_3$. The distances $d_2$, $d_3$ can be equal or different. However, those skilled in the art will appreciate that an asymmetric spacing will have an impact on the radiation pattern of the antenna apparatus 100.

While the first and second antennas 103*a*, 103*b* illustrated in FIG. 1A are folded dipole antennas those skilled in the art will appreciate from the present disclosure that the first and second antennas 103*a*, 103*b* can be each individually configured, without limitation, as one of a monopole antenna, a dipole antenna, a rhombic antenna, a planar antenna, and a yagi antenna. Those skilled in the art will appreciate that the radiation pattern of the resulting antenna apparatus will change as a function of the antenna types chosen for the respective first and second antennas 103*a*, 103*b*.

Figure 1C:
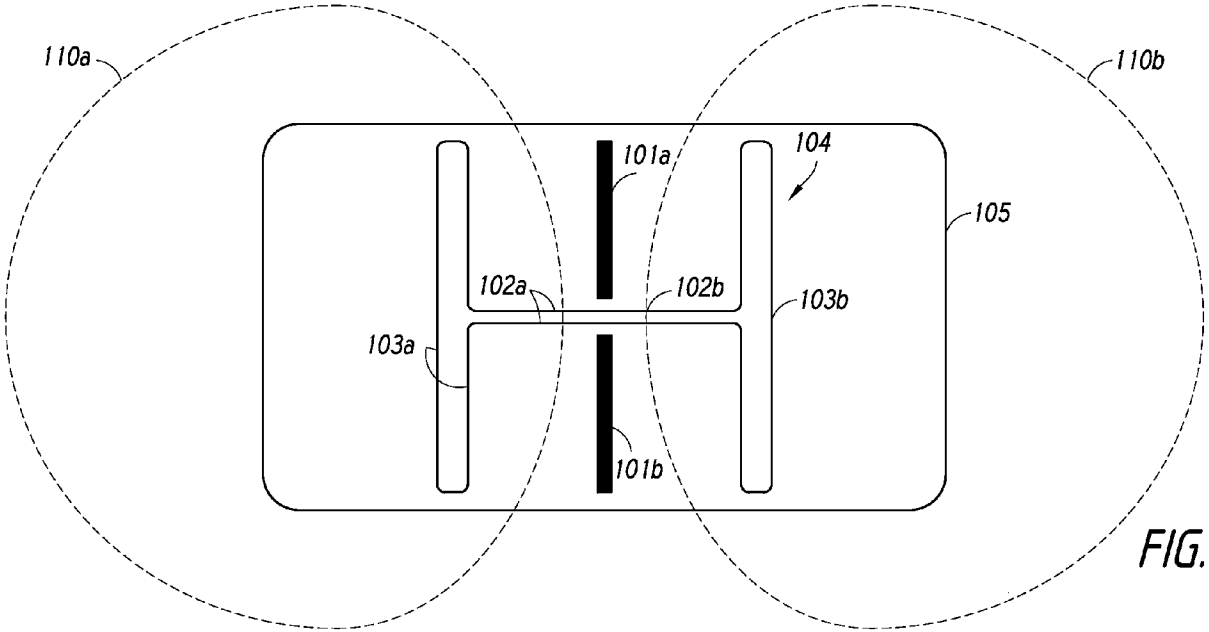
FIG. 1C is the plan view of the antenna apparatus of FIG. 1A illustrated with an approximation of the radiation pattern of the antenna apparatus.
Figure 1D:
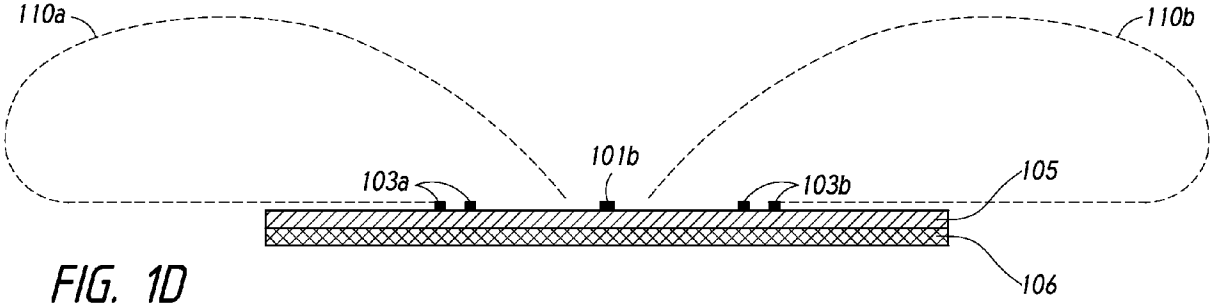
FIG. 1D is the cross-sectional view of the antenna apparatus of FIG. 1B shown with an approximation of the radiation pattern of the antenna apparatus.

FIG. 1C is the plan view of the antenna apparatus 100 of FIG. 1A illustrated with an approximation of the radiation pattern of the antenna apparatus. Similarly, FIG. 1D is the cross-sectional view of the antenna apparatus 100 shown with a cross-sectional view of the same approximation of the radiation pattern of the antenna apparatus 100. With reference to both FIGS. 1C and 1D, the reflector portions 101*a*, 101*b* distort the toroidal radiation patterns of the first and second folded dipole antennas 103*a*, 103*b*. For the first folded dipole antenna 103*a* the result is a radiation pattern approximated by the dashed line 110*a* in FIGS. 1C and 1D. For the second folded dipole antenna 103*b* the result is a radiation pattern approximated by the dashed line 110*b* in FIGS. 1C and 1D. In operation, RF signals received by one of the antennas are coupled through the coupling element and propagated through the respective radiation pattern of the other.

Figure 2A:
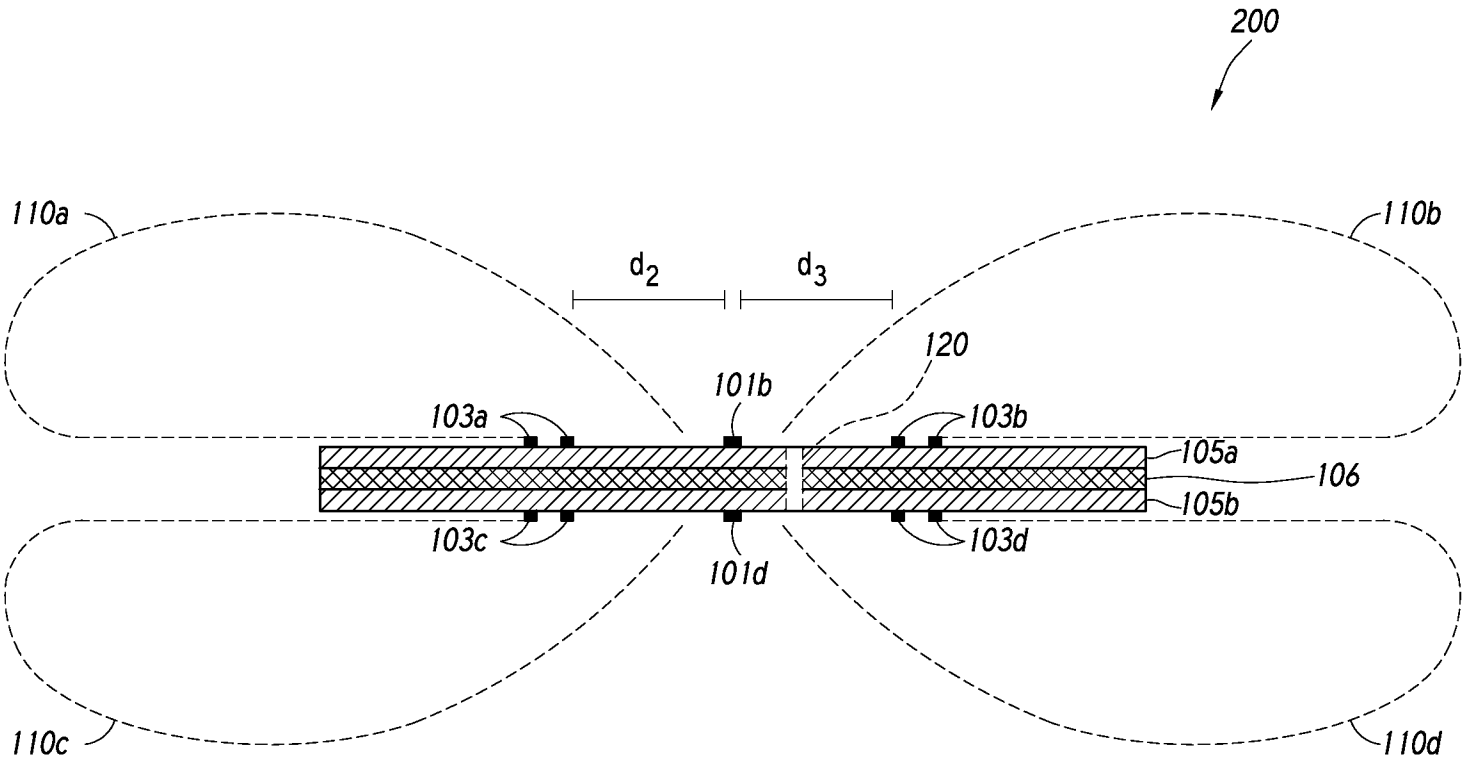
FIG. 2A is a cross-sectional view of one embodiment of an antenna apparatus.
Figure 2B:
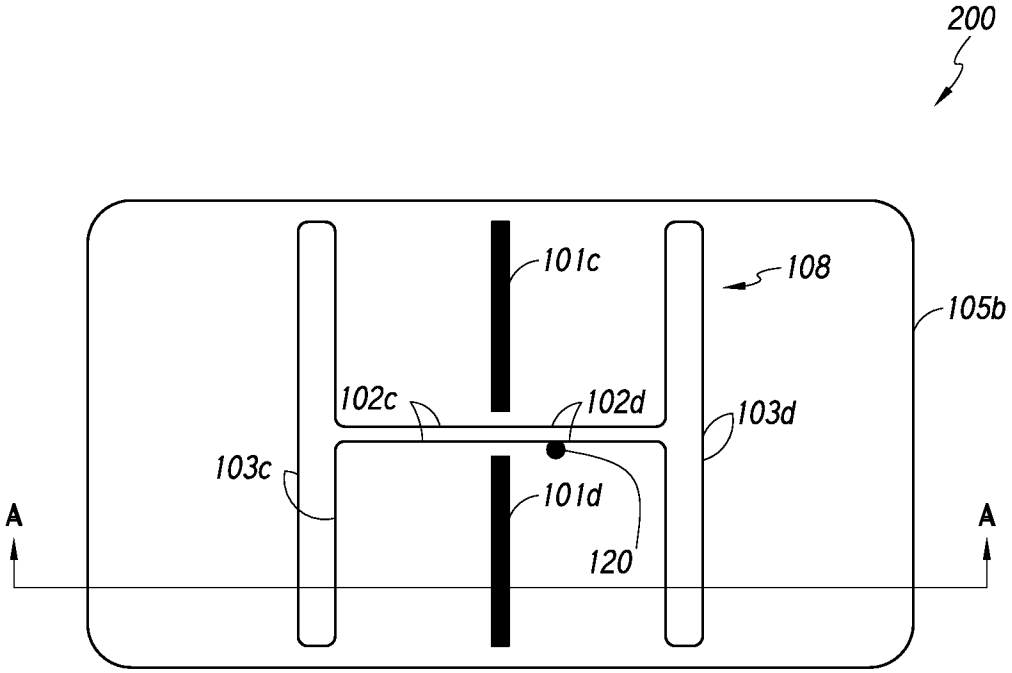
FIG. 2B is a plan view of the antenna apparatus of FIG. 2A.

FIGS. 2A and 2B provide views of an antenna apparatus 200. The antenna apparatus 200 illustrated in FIGS. 2A and 2B is similar to and adapted from the antenna apparatus 100 illustrated in FIG. 1A. Accordingly, elements common to both antenna apparatus 100 and 200 share common reference indicia, and only differences between the antenna apparatus 100 and 200 are described herein for the sake of brevity. However, for the sake of facilitating the description only, the dielectric layer 105 shown in FIGS. 1A-1D has been relabeled as the first dielectric layer 105*a* in FIGS. 2A-2B.

More specifically, FIG. 2A is a cross-sectional view of the antenna apparatus 200, and FIG. 2B is a plan view of the antenna apparatus 200. In addition to the elements illustrated in FIGS. 1A-1B, the antenna apparatus illustrated in FIGS. 2A-2B includes a second dielectric layer 105*b* on the second face of the electromagnetically reflective layer 106, and an arrangement of conductors on the second dielectric layer 105*b*. The arrangement of conductors on the second dielectric layer 105*b* includes a resonator 108 and a reflector comprising first and second portions 101*c*, 101*d*.

In some embodiments, the antenna apparatus 200 additionally includes an optional conductive via 120 extending through the first dielectric layer 105*a*, the electromagnetically reflective layer 106 and the second dielectric layer 105*b*. The conductive via 120 electrically connects the first and second coupling elements. Additionally, a dielectric separator is interposed between the electromagnetically reflective layer 106 and the conductive via 120 in order to electrically isolate one from the other.

The resonator 108 includes third and fourth antennas 103*c*, 103*d* electrically connected by a coupling element. For the sake of facilitating the present description only, the coupling element is labeled as having two portions 102*c*, 102*d*. In the antenna apparatus 200 the two portions of the coupling element 102*c*, 102*d* are arranged so as to be collinear forming a straight conductive path between the third and fourth antennas 103*c*, 103*d*.

The reflector includes first and second portions 101*c*, 101*d* separated by a gap through which the coupling element extends and intersects the longitudinal axis of the reflector. In some embodiments, the reflector is a single conductor (not shown), and the antenna apparatus 200 further includes a dielectric separator (not shown) between the reflector and the coupling element. The dielectric separator is provided to electrically isolate the reflector and the coupling element. In other words the dielectric separator prevents the reflector from shorting to the coupling element.

The third and fourth antennas 103*c*, 103*d* are folded dipole antennas, and the respective feed point of each of the third and fourth antennas 103*c*, 103*d* includes respective first and second feed terminals. Accordingly, the two portions of the coupling element 102*c*, 102*d* include first and second parallel conductive traces. The first conductive trace electrically connects the respective first feed terminals of the third and fourth antennas 103*c*, 103*d*. The second conductive trace electrically connects the respective second feed terminals of the third and fourth antennas 103*c*, 103*d*.

Those skilled in the art will recognize from the present disclosure and drawings that the respective arrangements of conductors on the respective first and second dielectric layers 105*a*, 105*b* are substantially identical. The resulting radiation pattern of the antenna apparatus 200 is therefore substantially symmetric. In particular, the radiation pattern created by the reflector portions 101*c*, 101*d* and the third and fourth antennas 103*c*, 103*d* being the substantial mirror image of the radiation pattern created by the reflector portions 101*a*, 101*b* and the first and second antenna 103*a*, 103*b*.

FIG. 2A shows a cross-sectional view of an approximation of the radiation pattern for the antenna apparatus 200. The reflector portions 101*a*, 101*b* distort the toroidal radiation patterns of the first and second folded dipole antennas 103*a*, 103*b*. The reflector portions 101*c*, 101*d* distort the toroidal radiation patterns of the third and fourth folded dipole antennas 103*c*, 103*d*. For the first folded dipole antenna 103*a* the result is a radiation pattern approximated by the dashed line 110*a*. For the second folded dipole antenna 103*b* the result is a radiation pattern approximated by the dashed line 110*b*. For the third folded dipole antenna 103*c* the result is a radiation pattern approximated by the dashed line 110*c*. For the fourth folded dipole antenna 103*d* the result is a radiation pattern approximated by the dashed line 110*d*. In operation, RF signals received by one of the antennas are coupled through the coupling element and propagated through the respective radiation pattern of the other. The via 120 allows signal energy to be received on one side of the electromagnetically reflective layer 106 and propagated through the radiation patterns of the respective antennas on the other side of the electromagnetically reflective layer 106.

Those skilled in the art will also appreciate from the present disclosure that the respective arrangements of conductors do not have to be substantially identical, and can instead be configured in any number of ways in order to create different radiation patterns for one or more of the first, second, third and fourth antennas.

Figure 3:
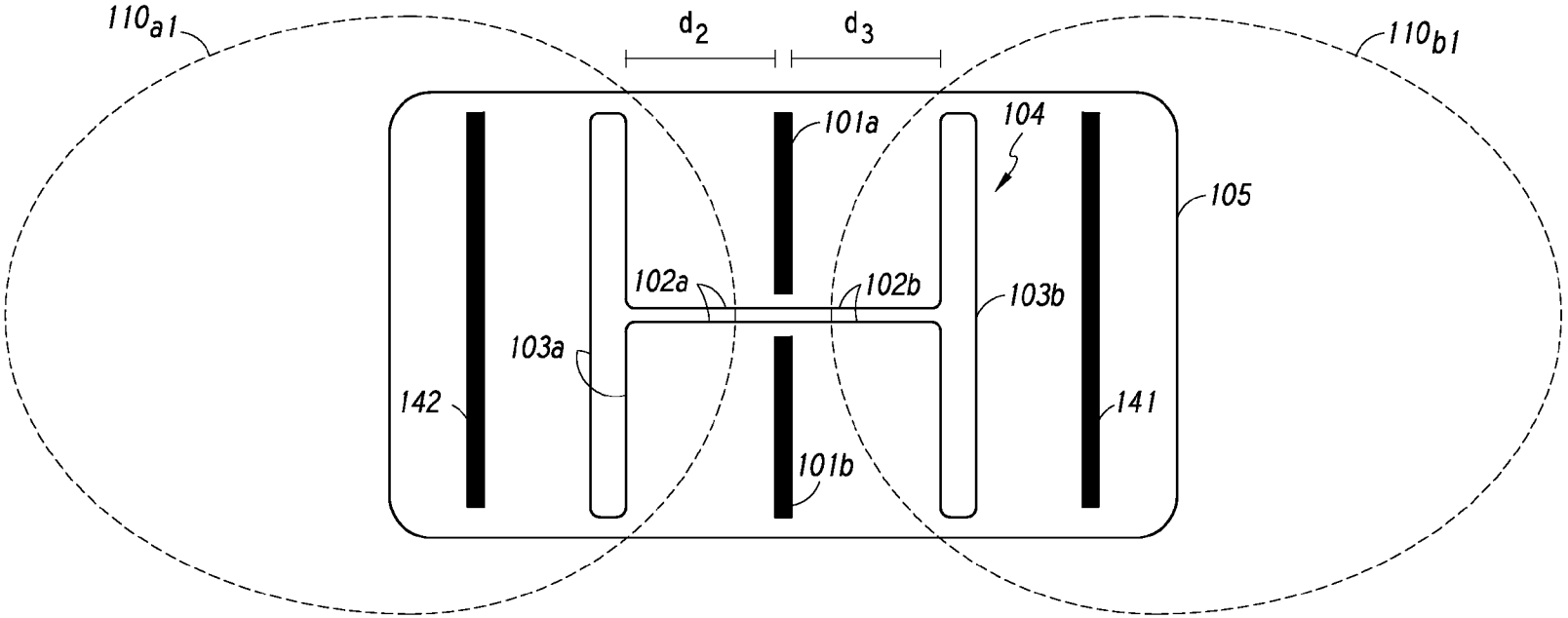
FIG. 3 is a plan view of one embodiment of an antenna apparatus illustrated with an approximation of the radiation pattern of the antenna apparatus.

FIG. 3 is a plan view of an antenna apparatus 300 illustrated with an approximation of its radiation pattern. The antenna apparatus 300 illustrated in FIG. 3 is similar to and adapted from the antenna apparatus 100 illustrated in FIG. 1A. Accordingly, elements common to both antenna apparatus 100 and 300 share common reference indicia, and only differences between the antenna apparatus 100 and 300 are described herein for the sake of brevity.

With reference to FIG. 3 the first arrangement of conductors additionally includes first and second director elements 142, 141. The first director 142 is positioned adjacent the first folded dipole antenna 103*a*, such that the first folded dipole antenna 103*a* is between the reflector portions 101*a*, 101*b* and the first director 142. The second director 141 is positioned adjacent the second folded dipole antenna 103*b*, such that the second folded dipole antenna 103*b* is between the reflector portions 101*a*, 101*b* and the second director 141. While the antenna apparatus 300 includes a director element adjacent each of the first and second antennas 103*a*, 103*b*, in another embodiment an antenna apparatus includes a single director adjacent one of the first and second antennas. In such an embodiment, the radiation pattern will be different from the approximated radiation pattern illustrated in FIG. 3. In another embodiment, an antenna apparatus includes multiple directors adjacent one of the first and second antennas.

As compared to the approximated radiation pattern illustrated in FIG. 1C, the first and second directors 142, 141 of FIG. 3 elongate the radiation pattern on either side of the reflector portions 101*a*, 101*b*. For the first folded dipole antenna 103*a* the result is an elongated radiation pattern approximated by the dashed line 110*a*$_1$. For the second folded dipole antenna 103*b* the result is an elongated radiation pattern approximated by the dashed line 110*b*$_1$.

Figure 4:
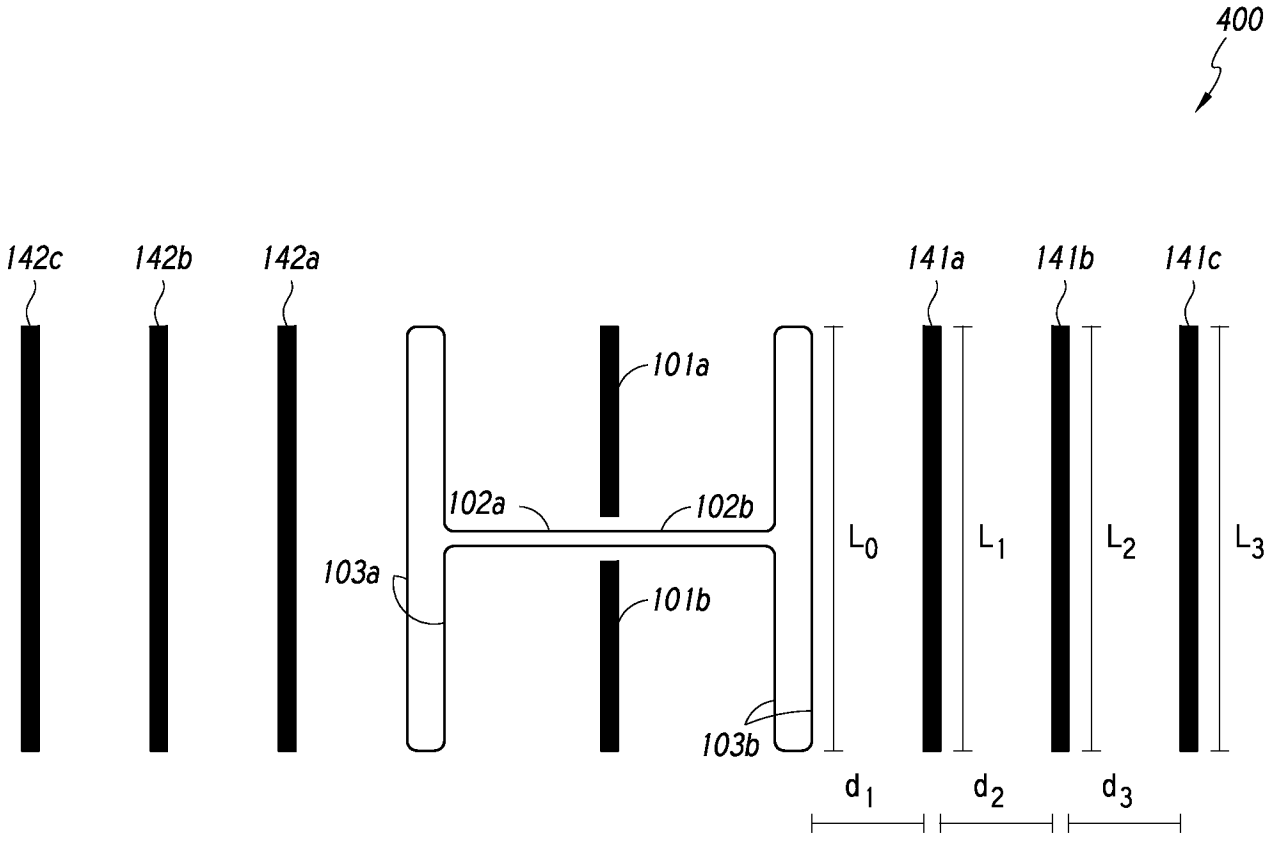
FIG. 4 is a plan view of one embodiment of an antenna apparatus.

FIG. 4 is a plan view of an antenna apparatus 400, in which only the arrangement of conductors disposed on the dielectric layer is shown. The antenna apparatus 400 illustrated in FIG. 4 is similar to and adapted from the antenna apparatus 100 illustrated in FIG. 1A. Accordingly, elements common to both antenna apparatus 100 and 400 share common reference indicia, and only differences between the antenna apparatus 100 and 400 are described herein for the sake of brevity.

With reference to FIG. 4, the arrangement of conductors additionally includes a plurality of directors 142*a*, 142*b*, 142*c* parallel to the reflector portions 101*a*, 101*b*, and positioned such that the first folded dipole antenna 103*a* is between the plurality of directors 142*a*, 142*b*, 142*c* and the reflector portions 101*a*, 101*b*. Additionally, the arrangement of conductors includes a plurality of directors 141*a*, 141*b*, 141*c* parallel to the reflector portions 101*a*, 101*b*, and positioned such that the second folded dipole antenna 103*b* is between the plurality of directors 141*a*, 141*b*, 141*c* and the reflector portions 101*a*, 101*b*. While only three directors are shown with each antenna in FIG. 4, those skilled in the art will appreciate that an antenna can be provided with any number of directors or even no directors at all. Moreover, each antenna may include more or less directors than other antennas in the same apparatus.

The respective distances between the directors can be varied to change the radiation pattern of the antenna apparatus 400. Examples are described in further detail below with further reference to FIG. 4, in which the distances $d_1$, $d_2$, and $d_3$ correspond to the respective distance between the second folded dipole antenna 103*b* and the director 141*a*, the respective distance between the directors 141*a*, 141*b*, and the respective distance between the directors 141*b*, 141*c*.

The respective lengths of the directors can be varied to change the bandwidth of the antenna apparatus 400. Examples are described in further detail below with further reference to FIG. 4, in which the lengths $L_0$, $L_1$, $L_2$, and $L_3$ correspond to the length of the second folded dipole antenna 103*b*, the director 141*a*, the director 141*b*, and the director 141*c*, respectively.

In some embodiments, the plurality of directors are arranged so that the respective distance between adjacent directors decreases between successive pairs of directors starting from the distance between the first of the plurality of directors immediately adjacent to one of the first and second antennas. For example, with further reference to FIG. 4, when the distances $d_1$, $d_2$, and $d_3$ are such that $d_1<d_2$, $<d_3$ the radiation pattern of the second folded dipole antenna 103*b* bulges outward parallel to the longitudinal axis of the reflector portions 101*a*, 101*b*.

In some embodiments, the plurality of directors are arranged so that the respective distance between adjacent directors increases starting from the distance between the first of the plurality of directors immediately adjacent to one of the first and second antennas. For example, with further reference to FIG. 4, when the distances $d_1$, $d_2$, and $d_3$ are such that $d_1>d_2$, $>d_3$ the radiation pattern of the second folded dipole antenna 103*b* elongates in a manner similar to the radiation pattern 110*b*$_1$ illustrated in FIG. 3.

In some embodiments, the plurality of directors are configured so that the length of a particular director is shorter than the immediately adjacent director starting from the first of the plurality of directors immediately adjacent to one of the first and second antennas. For example, with further reference to FIG. 4, when the lengths $L_1$, $L_2$, and $L_3$ are such that $L_1<L_2$, $<L_3$ the radiation pattern of the second folded 103*b* dipole antenna increases on the higher frequency end of the bandwidth.

In some embodiments, the plurality of directors are configured so that the length of a particular director is longer than the immediately adjacent director starting from the first of the plurality of directors immediately adjacent to one of the first and second antennas. For example, with further reference to FIG. 4, when the lengths $L_1$, $L_2$, and $L_3$ are such that $L_1>L_2$, $>L_3$ the bandwidth of the second folded dipole antenna 103*b* increases on the lower frequency end of the bandwidth.

Figure 5:
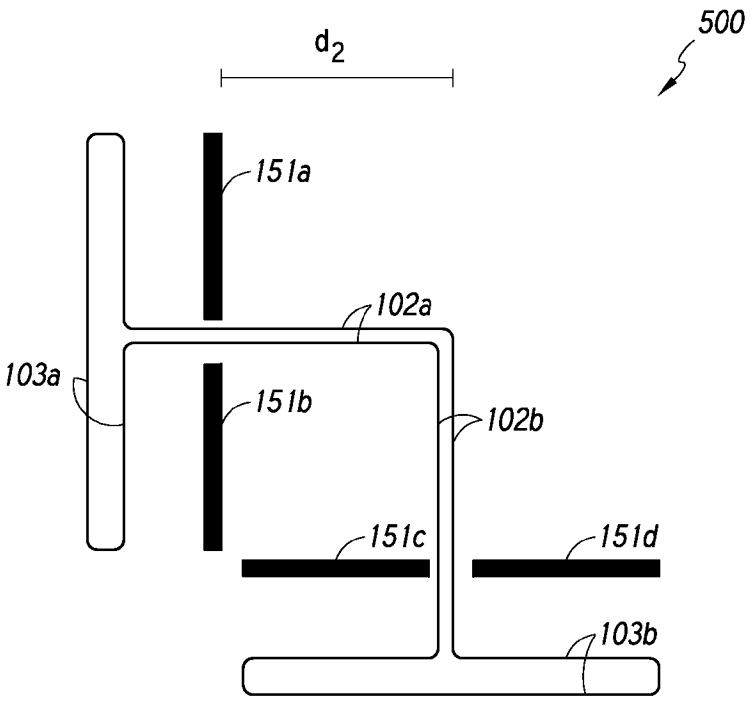
FIG. 5 is a plan view of one embodiment of an antenna apparatus.

FIG. 5 is a plan view of an antenna apparatus 500, in which only the arrangement of conductors disposed on the dielectric layer is shown. The antenna apparatus 500 illustrated in FIG. 5 is similar to and adapted from the antenna apparatus 100 illustrated in FIG. 1A. Accordingly, elements common to both antenna apparatus 100 and 500 share common reference indicia, and only differences between the antenna apparatus 100 and 500 are described herein for the sake of brevity.

In contrast to FIG. 1A, with reference to FIG. 5, the two portions of the coupling element 102*a*, 102*b* meet at a corner and the first and second antennas 103*a*, 103*b* are arranged facing respective first and second directions. While the two portions of the coupling element 102*a*, 102*b* are illustrated as being perpendicular to one another, those skilled in the art will appreciate from the present disclosure that the two portions of the coupling element 102*a*, 102*b* can be arranged at any angle in order to customize the radiation pattern of the antenna apparatus.

Additionally, the antenna apparatus 500 includes two reflectors. The first reflector includes portions 151*a*, 151*b* separated by a gap through which the first coupling element portion 102*a* extends and intersects the longitudinal axis of the first reflector. The second reflector includes portions 151*c*, 151*d* separated by a gap through which the second coupling element portion 102*b* extends and intersects the longitudinal axis of the second reflector.

Additionally, the distance between the reflector portions 151*a*, 151*b* and the corner is $d_2$, and the distance between the reflector portions 151*c*, 151*d* and the corner is $d_3$. The distances $d_2$, $d_3$ can be equal or different.

Figure 6:
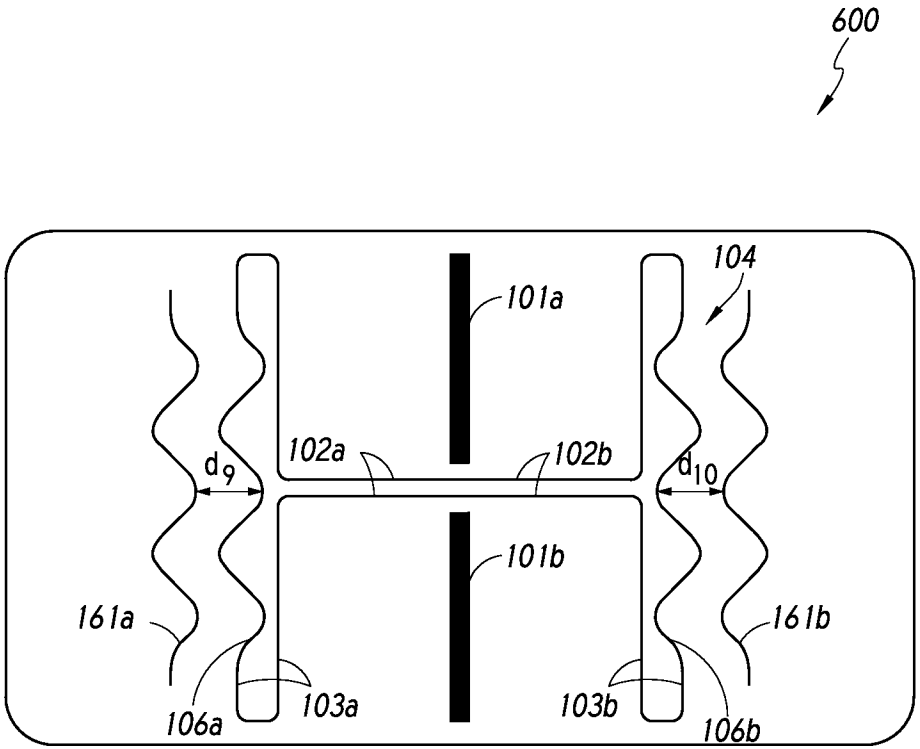
FIG. 6 is a plan view of one embodiment of an antenna apparatus.

FIG. 6 is a plan view of an antenna apparatus 600, in which only the arrangement of conductors disposed on the dielectric layer is shown. The antenna apparatus 600 illustrated in FIG. 6 is similar to and adapted from the antenna apparatus 100 illustrated in FIG. 1A. Accordingly, elements common to both antenna apparatus 100 and 600 share common reference indicia, and only differences between the antenna apparatus 100 and 600 are described herein for the sake of brevity.

With reference to FIG. 6, the first folded dipole antenna 103*a* includes an undulating portion 106*a*. The undulating portion 106*a* is duplicated by the director 161*a* such that the distance $d_9$ between corresponding points on the undulating portion 106*a* and the director 161*a* is substantially constant along the length of each. Similarly, the second folded dipole antenna 103*b* includes an undulating portion 106*b*. The undulating portion 106*b* is duplicated by the director 161*b* such that the distance $d_{10}$ between corresponding points on the undulating portion 106*b* and the director 161*b* is substantially constant along the length of each. The undulating portions 106*a*, 106*b* allow the antenna apparatus to be scaled down while substantially preserving the defining wavelengths of the first and second folded dipole antennas 103*a*, 103*b*. While only one director is shown with each antenna in FIG. 6, those skilled in the art will appreciate that an antenna can be provided with any number of directors or even no directors at all. For example, each dipole antenna 103*a*, 103*b* shown in FIG. 6 can include two directors. Moreover, each antenna may include more or less directors than other antennas in the same apparatus.

Moreover, in some embodiments, the curvature of the undulations is configured to reduce the concentration of RF energy at inflection points where the metal traces change directions. By contrast, those skilled in the art will appreciate from the present disclosure that sharp corners (e.g. creating a zig-zag) pattern would result in a concentration of RF energy at the corners, which thereby substantially changes the density of RF energy along the length of the first and second antennas and/or the director elements.

Figure 7:
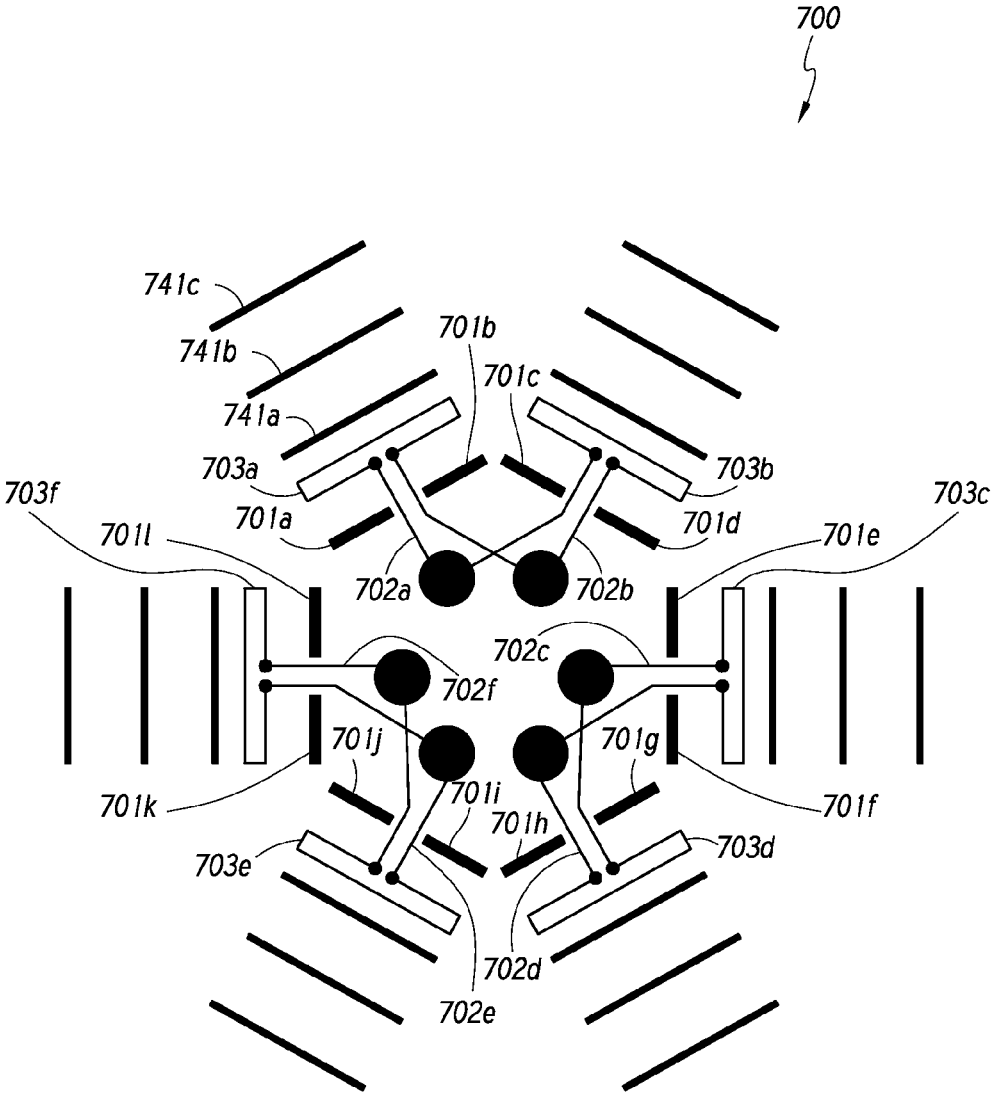
FIG. 7 is a plan view of one embodiment of an antenna apparatus.

FIG. 7 is a plan view of an antenna apparatus 700, in which only the arrangement of conductors disposed on the dielectric layer is shown. The arrangement of conductors includes folded dipole antennas 703*a*, 703*b*, 703*c*, 703*d*, 703*e*, 703*f*, reflector portions 701*a*, 701*b*, 701*c*, 701*d*, 701*e*, 701*f*, 701*g*, 701*h*, 701*i*, 701*j*, 701*k*, 701*l*, and conductive traces 702*a*, 702*b*, 702*c*, 702*d*, 702*e*, 702*f*. Each folded dipole antenna 703*a*, 703*b*, 703*c*, 703*d*, 703*e*, 703*f* is provided with an adjacent plurality of directors. For example, the folded dipole antenna 703*a* is provided with directors 741*a*, 741*b*, 741*b*. While only three directors are shown in FIG. 7, those skilled in the art will appreciate that an antenna can be provided with any number of directors or even no directors at all. Moreover, each antenna may include more or less directors than other antennas in the same apparatus.

The folded dipole antennas 703*a*, 703*b*, 703*c*, 703*d*, 703*e*, 703*f* are arranged in a hexagonal approximation of a circle. Each of the folded dipole antennas 703*a*, 703*b*, 703*c*, 703*d*, 703*e*, 703*f* is paired with one adjacent antenna. Specifically, antennas 703*a* and 703*b* are paired, antennas 703*c* and 703*d* are paired, and antennas 703*e* and 703*f* are paired. The result is that the radiation pattern formed by a pair of antennas approximates a bent pipe from one side of the arrangement of antennas to an adjacent side, such that signals received on one side are propagated from the adjacent side.

Conductive traces 702*a*, 702*b* electrically connect the respective first and second feed terminals of the antennas 703*a*, 703*b*. Conductive traces 702*c*, 702*d* electrically connect the respective first and second feed terminals of the antennas 703*c*, 703*d*. Conductive traces 702*e*, 702*f* electrically connect the respective first and second feed terminals of the antennas 703*e*, 703*f*.

The conductive traces 702*a*, 702*b* extend through a gap separating reflector portions 701*a*, 701*b*. The conductive traces 702*a*, 702*b* also extend through a gap separating reflector portions 701*c*, 701*d*. The conductive traces 702*c*, 702*d* extend through a gap separating reflector portions 701*e*, 701*f*. The conductive traces 702*c*, 702*d* also extend through a gap separating reflector portions 701*g*, 701*h*. The conductive traces 702*e*, 702*f* extend through a gap separating reflector portions 701*i*, 701*j*. The conductive traces 702*e*, 702*f* also extend through a gap separating reflector portions 701*k*, 701*l*.

Figure 8:
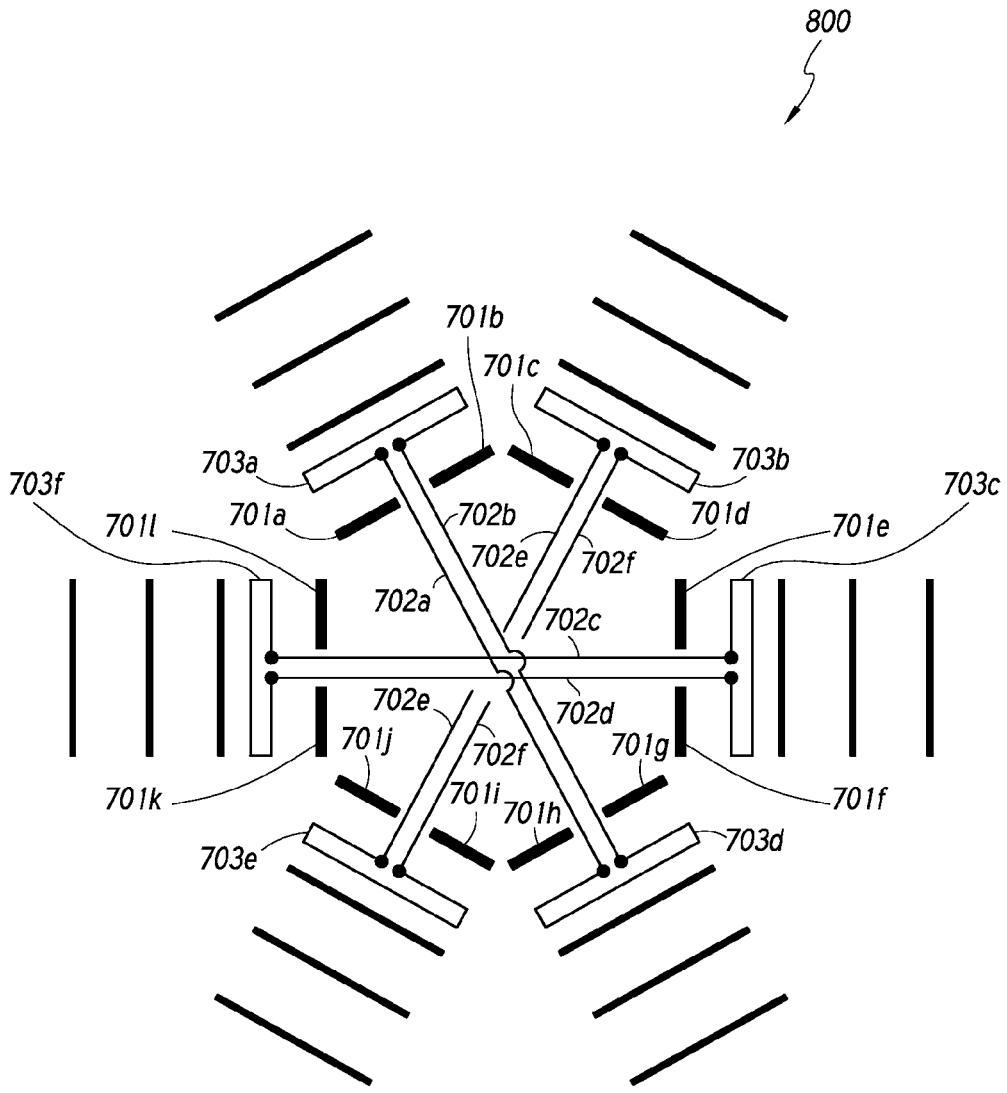
FIG. 8 is a plan view of one embodiment of an antenna apparatus.

FIG. 8 is a plan view of an antenna apparatus 800, in which only the arrangement of conductors disposed on the dielectric layer is shown. The antenna apparatus 800 illustrated in FIG. 8 is similar to and adapted from the antenna apparatus 700 illustrated in FIG. 7. Accordingly, elements common to both antenna apparatus 700 and 800 share common reference indicia, and only differences between the antenna apparatus 700 and 800 are described herein for the sake of brevity.

As compared to the antenna apparatus 700, each of the folded dipole antennas 703*a*, 703*b*, 703*c*, 703*d*, 703*e*, 703*f* is respectively electrically paired and connected to the corresponding folded dipole antenna diametrically opposite a particular one of the folded dipole antennas. Specifically, antennas 703*a* and 703*d* are electrically coupled by parallel conductive traces 702*a*, 702*b*, antennas 703*b* and 703*e* are electrically coupled by parallel conductive traces 702*e*, 702*f*, and antennas 703*c* and 703*f* are electrically coupled by parallel conductive traces 702*c*, 702*d*. The conductive traces 702*e*, 702*f* electrically coupled to antennas 703*b*, 703*e* are partially hidden to simplify the view in FIG. 8; those traces 702*e*, 702*f* are configured to electrically couple the antennas 703*b*, 703*e* despite a portion of the traces 702*e*, 702*f* not being shown. The result is that the radiation pattern formed by a pair of antennas approximately extends from one side of the arrangement of antennas through to a diametrically opposite side, such that signals received on one side are propagated from the diametrically opposite side.

Additionally and/or alternatively, an embodiment of an antenna apparatus can be combined with a user interface. The user interface may include a detector circuit and a user-readable display, such as a series of diodes or a liquid crystal display. In some embodiments, the detector circuit is coupled between the resonant structure of an antenna apparatus and the user interface. The detector circuit can be configured to draw off a small portion of RF signal energy received by one or more of the antennas in operation. The detector can provide a signal to the user interface according to how much RF signal energy is detected. For example, the detector can be configured to detect RF signal energy in relation to two or more threshold levels. If RF signal energy is lower than a first threshold level, the detector signals that the RF signal energy is very weak or non-existent. If RF signal energy is between the first and second threshold levels, the detector signals that the RF signal energy is low. If RF signal energy is higher than the second threshold level, the detector signals that the RF signal energy is strong. In response to receiving the detector signal, the user interface provides a corresponding user readable output that can be interpreted by a user. The user readable output can include one or more visual indicators, displays, lamps, other output devices, or a combination of devices. In some embodiments, the user interface and/or the detector circuit can be disposed in a single housing that also contains the antenna apparatus.

Multipath Interference in Buildings Overview

Much of the previous discussion describes examples of antenna apparatuses that may be placed within a short range, e.g., 6-24 inches, of a wireless device to increase the RF signal intensity of RF signals near the wireless device. However, the antenna apparatuses are not limited as such. As will now be described, in certain embodiments, the aforementioned antenna apparatuses (e.g., antenna apparatus 100, 200, 400, 500, 600, and 700) may be applied on a wider scale. For example, the antenna apparatuses may be utilized to improve the signal intensity of RF signals in a building. Further, the antenna apparatuses may be used to reduce multipath interference of wireless signals in a building.

Figure 9:
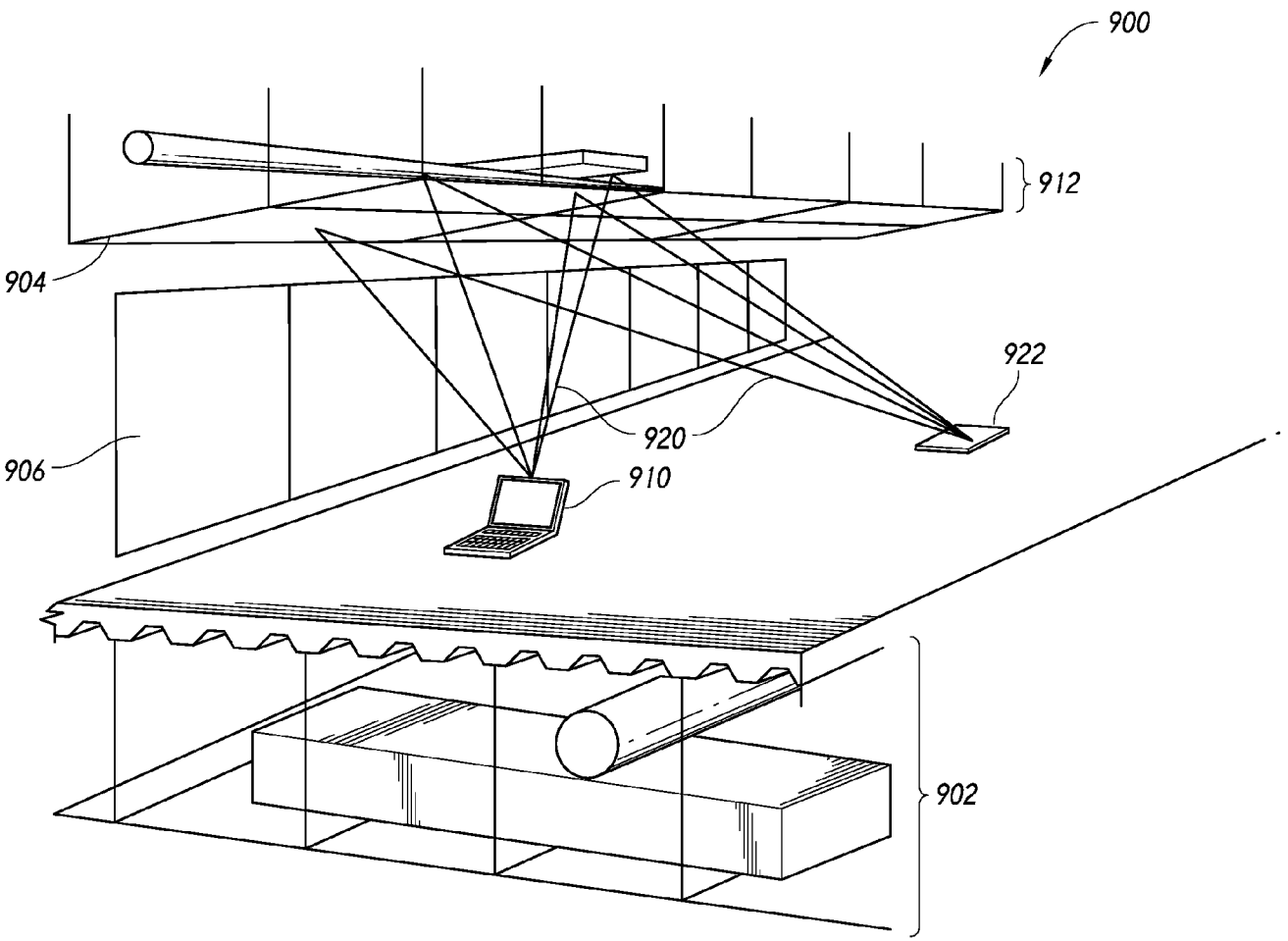
FIG. 9 is a cutaway view of a floor of a building illustrating the problem of multipath interference from wireless radio frequency communication transmissions.

FIG. 9 is a cutaway view of one floor 900 of a building illustrating the problem of multipath interference from wireless radio frequency communication transmissions. As used herein, the term "floor" generally refers to the space between a ceiling structure and a floor structure where, for example, users may live or work. In some cases, the term "floor" may further include one or more of the ceiling structure and floor structure. In other cases, the term "floor" may refer to just the space between the ceiling structure and the floor structure.

The floor 900 is included in one non-limiting example of an office-building. It should be understood that the type of building is not limited and that the problems that will be described, and their solutions, may apply in a variety of building types (e.g., a factory, a mall, an office-building, a warehouse, etc.) and building sizes (e.g., 1,000, 10,000, 100,000, 200,000 square feet, etc.).

The floor 900 may include a floor structure 902 opposite to a ceiling structure 912. In some cases, the floor structure 902 can serve as a ceiling structure to a floor below the floor 900. The floor structure 902 may include a "top hat" decking floor, which may be metal, with a concrete pour on it. Over the concrete, there may exist a floor covering material (e.g., carpet or laminate). Underneath the "top hat" decking floor, there may exist a number of metallic structures often found in buildings such as duct work, metal hangers, piping, sprinklers, and the like. Similar structures may exist as part of the ceiling structure 912. In other words, the ceiling structure may include metal piping, wire hangers, ductwork (e.g., for HVAC systems), sprinkler systems, etc. The bottom of the ceiling structure 912 may include a set of ceiling tiles 904 that face the floor structure 902 of the floor 900. The ceiling tiles 904 are often manufactured from RF transparent material, such as mineral wool. Further, in many buildings, the windows 906 may be covered with a metalized film to shield out sun from entering the floor 900 at full intensity. These metalized windows 906 may, in some cases, reflect or block external signals from entering the building thereby reducing access to, for example, cellular telephone networks. In other embodiments, the metalized windows 906 do not interfere with RF signals and do not impact communications. The impact of the windows 906 on communications may depend on the coating material, the density of the coating, and the application method of the coating to the windows 906, among other factors.

FIG. 9 also illustrates a computer 910 that can communicate wirelessly with a router 922. Although only one computer and router are illustrated, it should be understood that any number of computing systems (e.g., laptops, smartphones, tablets, smart appliances, networked televisions, etc.) and any number of routers or other networking equipment may exist both on the floor 900 and in other floors, if any, of the building. Further, the computer 910 and the router 922 may communicate as part of an internal network (e.g., Local Area Network or LAN) and/or as part of a connection to an external network (e.g., the Internet).

Various metallic structures in the building, such as those previously described (e.g., the duct work, wire hangers, metalized windows, etc.), may cause numerous reflections, which are often unpredictable, of the RF signals transmitted/received by the computer 910/router 922. These reflections, illustrated by the reflection lines 920, can result in signal interference and distortions that can cause degradation in the reliability, speed, and coverage area of a wireless network. This signal interference and/or distortion is often termed "multipath interference" or "multipath distortion." The lack of uniformity in both the structure of many buildings as well as in the structures in the ceilings between floors makes compensating for multipath interference challenging.

Example Antenna Apparatus Application—Buildings

In certain embodiments, replacing and/or modifying the ceiling tiles 904 with a metallic ground plane assembly constructed from metallic ground plane tiles can reduce unpredictable multipath interference by creating a more homogenous metallic place compared to many buildings that include a variety of metallic structures above the ceiling tiles as described with respect to the floor 900. Further, one or more of the ceiling tiles 904 may be replaced by an active antenna, which can reduce the occurrence of multipath interference and improve signal strength, which may result in increased data bandwidth.

Figure 10:
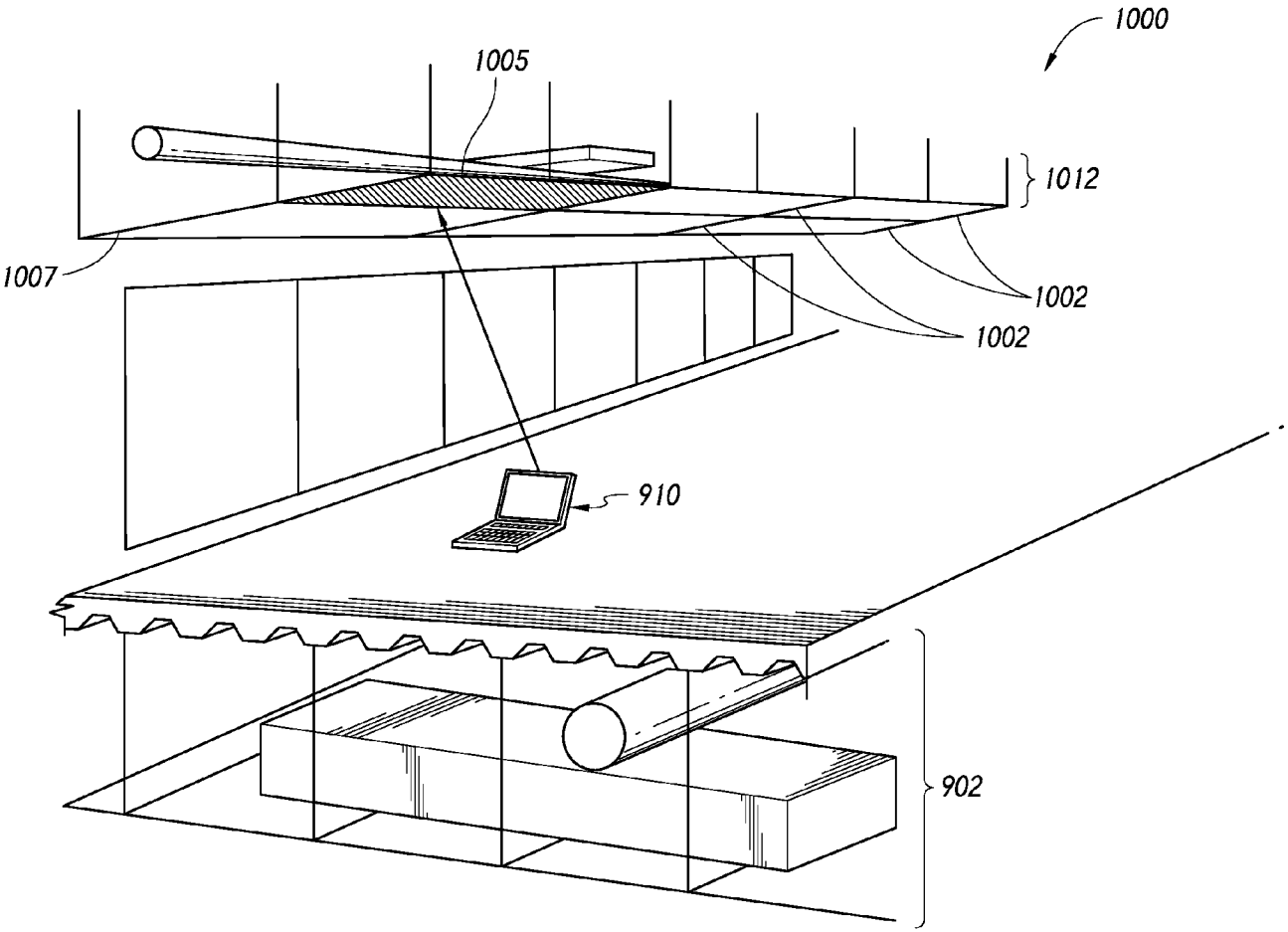
FIG. 10 is a cutaway view of a floor of a building with an active antenna and ground plane/RF shield built into ceiling tiles.

FIG. 10 is a cutaway view of a floor 1000 of a building with an active antenna and ground plane/RF shield built into ceiling tiles. The floor 1000 corresponds to the floor 900, but with a modification to the ceiling structure. The ceiling structure 1012 of the floor 1000 includes a ground plane assembly 1007 below the various structures in the ceiling that can contribute to multipath interference. The addition of the ground plane assembly 1007 reduces the multipath interference by creating a uniform or substantially uniform ground plane between the structures above the ceiling tiles (e.g., ducts, metal piping, wire hangers, etc.) and the space occupied by users and their computing equipment. The ground plane assembly can be created from a number of ground plane tiles 1002 that may be joined together to create a single uninterrupted ground plane. Often, the ceiling structure in large buildings is made by a number of tiles. These tiles are typically, but not necessarily, about 2 feet by 2 feet. At least some of the tiles in the ceiling structure 1012 are replaced with the ground plane tile 1002 to create the ground plane assembly 1007. In some embodiments, all the tiles of the ceiling structure may include the ground plane tile 1002. Some buildings may include lighting, vents for heating, ventilation, and air conditioning (HVAC) systems, sprinkler systems, and other features that interrupt the uniformity of the ceiling tiles. In such cases, tiles that include these features may be excluded from the ground plane assembly 1007. In other cases, the ground plane tiles may include openings to accommodate the features that interrupt the uniformity of the ceiling tiles (e.g., the sprinklers or HVAC vents).

Further, the ceiling may include an active antenna ceiling panel 1005. Each active antenna ceiling panel 1005 may include one or more antenna apparatuses described previously (e.g., antenna apparatus 100, 200, 400, 500, 600, and 700). However, the design of the active antennas included in the active antenna ceiling panel 1005 is not limited as such, and other antenna apparatus may be used, such as different Yagi, dipole, or planar antenna designs. Often, the selection of the antenna design may be application specific. In some embodiments, the active antenna ceiling panel 1005 may be a separate panel from the ground plane tiles 1002. In other embodiments, the antenna ceiling panel 1005 be included with a ground plane tile 1002. Embodiments of the ground plane assembly 1007, ground plane tiles 1002 and the active antenna ceiling panel 1005 are described in more detail below.

Using the structure illustrated in the floor 1000, multipath distortion may be mitigated and/or networks may be optimized. The ceiling tile with the active antenna 1005 may facilitate wireless communication with the computer 910 and/or a router (not shown). Because, in many cases, the ceiling tile with the active antenna ceiling panel 1005 is physically closer to each device capable of wireless communication, the multipath interference is decreased. Consequently, in some instances, the available bandwidth throughput may be increased, and the performance of the system may be increased.

Example Active Antenna Layer

Figure 11C:
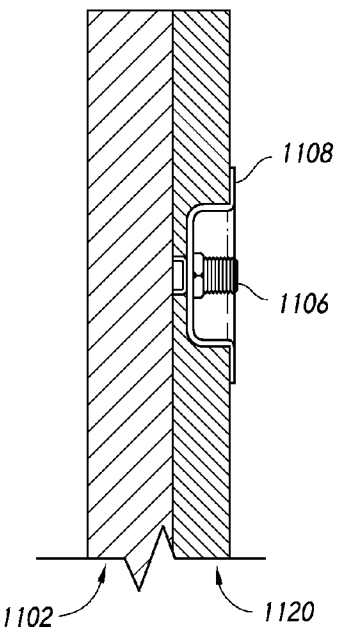
FIG. 11C is a detail view of a portion of one embodiment of the active antenna layer and ground plane layer circled in FIG. 11B.
Figure 11B:
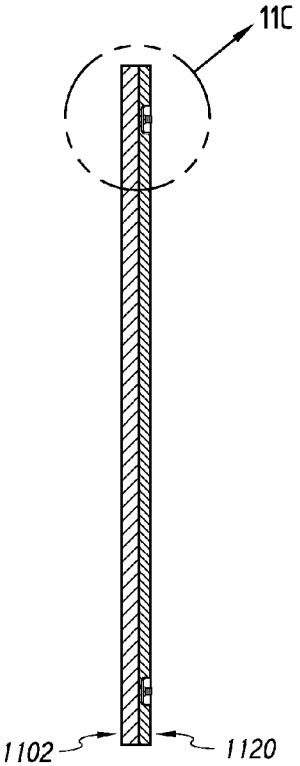
FIG. 11B is a cross-sectional view of one embodiment of the active antenna layer of FIG. 11A taken along line 11B-11B with a ground plane layer.
Figure 11A:
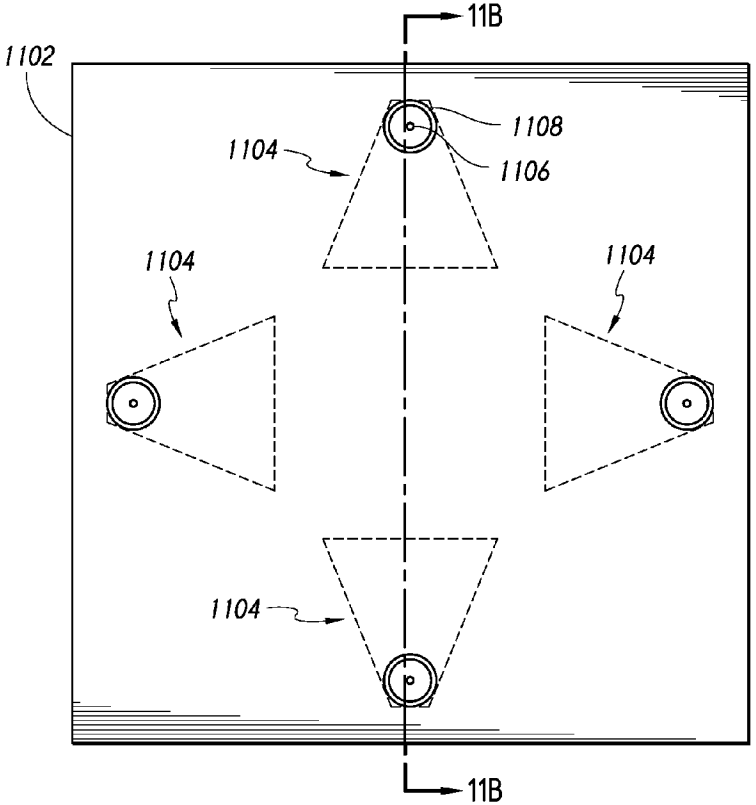
FIG. 11A is a plan view of one embodiment of an active antenna layer for an active antenna ceiling panel.

FIG. 11A is a plan view of one embodiment of an active antenna layer 1102 for an active antenna ceiling panel (e.g., the active antenna ceiling panel 1005). In certain embodiments the antenna layer 1102 is a printed circuit board. The antenna layer 1102 includes a number of antennas 1104 that are typically designed for high gain applications. The bandwidth supported by the antennas 1104 may, in some cases, be in the range of 700 MHz to 5.8 GHz or 6 GHZ. However, in some embodiments, the antennas 1104 may support other frequency ranges. Further, the antennas 1104 may be wireless technology agnostic enabling a variety of communication systems to be used with the active antenna ceiling panels.

Although FIG. 11A illustrates four antennas 1104, in some embodiments, the antenna layer 1102 may include other numbers of antennas, such as one, two, three, or five antennas. Further, the position and number of the antennas 1104 may be selected based on the desired final propagation of RF signals for a particular application (e.g., building configuration and/or network type). Each of the antennas 1104 of the antenna layer 1102 may be positioned equidistant from each other along a circle centered at the center of the antenna layer 1102. However, in some cases, the antennas 1104 may be positioned in a different configuration. For example, an active antenna ceiling panel configured for installation against a wall may have three antennas that are positioned in a triangular configuration with the edge of the ceiling panel against the wall not including an antenna 1104. As a second example, an active antenna ceiling panel configured for installation near a corner may include two antennas at a 90 degree angle from each other with one antenna facing away from one side of the panel against one wall and the other antenna facing away from a side of the panel against the other wall.

As illustrated in FIG. 11A, each of the antennas 1104 may be connected to a connector 1106 that is positioned within a metallic cup 1108. The connector 1106 enables the antennas 1104 to be connected to a communications device for signal transfer of the RF signal. For example, the antenna connector 1104 may be connected to a bidirectional amplifier to amplify RF signals received from a computing device by the antennas 1104 or from a donor antenna before providing the RF signal to the antenna 1104 for transmission to computing devices within the building floor.

Further, the metallic cup 1108 connects the ground connection of the antenna connector 1106 to a ground plane layer (not shown). The ground plane layer may be part of the ground plane 1007. The connection to the ground plane assembly 1007 creates continuity of the ground plane across the ceiling. The connection of the antenna layer 1102 to a ground plane layer is illustrated in FIG. 11B and FIG. 11C. Although four connectors 1106 and metallic cups 1108 are illustrated, there may be more or less connectors 1106 and metallic cups 1108. Generally, there may exist as many connectors 1106 and metallic cups 1108 as there are antennas 1104. However, in some cases there may be a different number of connectors 1106 and metallic cups 1108 as antennas 1104. For example, in some cases, a pair of antennas may be in communication with the same connector 1106.

As can be seen in FIG. 11B, the antenna layer 1102 may be positioned adjacent to and in electrical communication with a ground plane layer 1120. As stated above, and as will be described in more detail below, the ground plane layer 1120 may be joined with ground plane tiles 1002 such that the ground plane layer 1120 is included as part of the ground plane 1007. As will be described in more detail below with respect to FIG. 12, in some embodiments, a dielectric layer may exist on either side of the antenna layer 1102. In some cases, the dielectric layer between the antenna layer 1102 and the ground plane layer 1120 may be very thin (e.g., on the order of 1-2 mm).

FIG. 11C illustrates that the antenna connector 1106 extends from the antenna layer 1102 through the ground plane layer 1120. The metallic cup 1108 connects the antenna connector 1106 to the ground plane layer 1120.

Example Active Antenna Ceiling Panel Assembly

Figure 12:
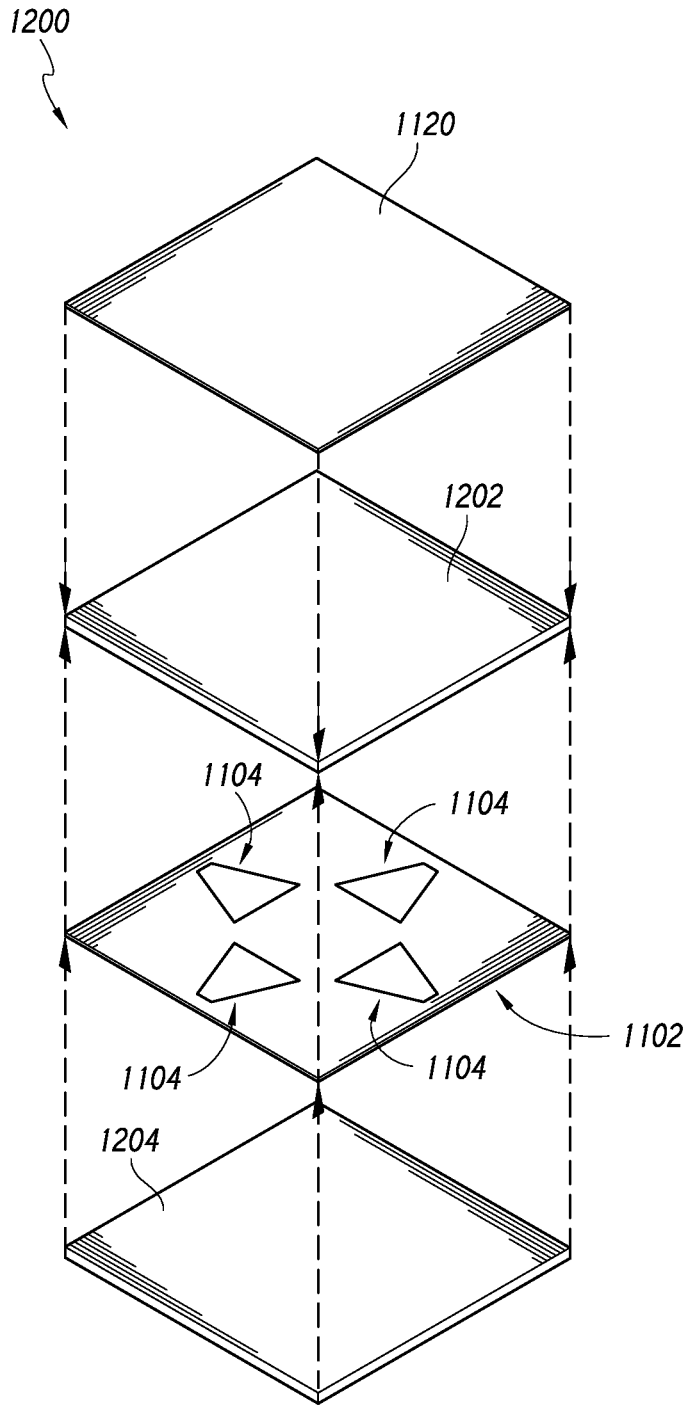
FIG. 12 is an assembly view of parts of an embodiment of an active antenna ceiling panel.

FIG. 12 is an assembly view of parts of an embodiment of an active antenna ceiling panel 1200. Although the active antenna ceiling panel 1200 may be used on its own, typically, the active antenna ceiling panel 1200 will be installed along with a ground plane assembly 1007. In such cases, as stated above, the ground plane layer 1120 may be joined to one or more ground plane tiles 1002 as part of the ground plane assembly 1007.

As illustrated in FIG. 12, the active antenna ceiling panel 1200 may include a number of layers. These layers are now discussed in order from the bottom or first layer that faces inside the room or floor to the top or last layer that faces the roof or floor above, and any ductwork or other structures in the ceiling.

The first layer of the active antenna ceiling panel 1200 is the dielectric material ceiling panel 1204. The dielectric material ceiling panel 1204 may include any type of ceiling material that may be used as an internal ceiling in a building and which may serve as a dielectric material. For example, the dielectric material ceiling panel 1204 may include mineral fiber materials used in ceilings, medium density fiber board, fiberglass, drywall, and many types of plastics (e.g., an acrylic-based plastic, or polyvinyl chloride). The dielectric material chosen for the dielectric material ceiling panel 1204 may be selected based on one or more of cost, acoustical properties, thickness required for desired dielectric and/or acoustical properties, temperature insulation, and aesthetic appearance.

The next layer of the active antenna ceiling panel 1200 is the antenna layer 1102. As previously described, this layer may include a number of antennas 1104. These antennas may be formed on a printed circuit board (PCB) that is integrated into the antenna layer 1102. In some cases, the entire antenna layer 1102 may comprise the PCB. In other cases, the PCB may be a portion of the antenna layer 1102. In certain embodiments, each antenna 1104, or a subset of the antennas 1104, may be formed on a separate PCB.

The antennas 1104 can include any type of antenna that may be used for facilitating wireless communications within a building. For example, the antennas 1104 may include Yagi, or Yagi-Uda, antennas, patch antennas, dipole antennas, folded dipole antennas, or any of the antenna designs previously described with respect to FIGS. 1A, 1B, 1C, 1D, 2A, 2B, and 3-8. Each of the antennas 1104 may be of the same antenna design. Alternatively, at least some of the antennas 1104 may be of different antenna designs. For example, two antennas 1104 may be Yagi antennas, and two antennas 1104 may be folded dipole antennas. As a second example, all four of the depicted antennas 1104 may be Yagi antennas, but two of the antennas 1104 may have a different number of elements or a different size feed element.

Advantageously, in certain embodiments, the use of different antenna designs within the same active antenna ceiling panel 1200 enables the wireless coverage to be optimized for the shape of the room that includes the active antenna ceiling panel 1200. Further, in some embodiments, the use of different antenna designs enables the active antenna ceiling panel 1200 to be optimized for use with different signal frequencies and/or for different communication protocols. In some embodiments, the antennas 1104 may be used for different communications networks. For example, two of the antennas 1104 may be used to improve the coverage of a cellular phone network within a building and two of the antennas 1104 may be used as part of a wireless intranet. In such cases, the antennas 1104 of the antenna layer 1102 are likely to comprise different antenna designs configured to support different frequencies.

In some cases, the antennas 1104 are created as conductive traces that sit atop the PCB. In other embodiments, the antennas 1104 may be integrated into the antenna layer 1102 such that the thickness of the antenna 1104 is equal to that of the antenna layer 1102. In other words, in some cases, the antenna 1104 may face both the dielectric ceiling panel 1204 and the dielectric layer 1202. The antennas 1104 may be created from any conductive material that may be used for communications antennas. For example, the antennas 1104 may be created from copper, silver, aluminum, etc. In some embodiments, the antennas 1104 may be created from metamaterials.

Above the antenna layer 1102 sits the dielectric layer 1202. In some embodiments, the dielectric layer 1202 may be of the same material as the dielectric ceiling panel 1204. However, the thickness of the dielectric layer 1202 may or may not be the same thickness as the dielectric ceiling panel 1110. In some embodiments, the dielectric layer 1202 may be a very thin layer (e.g., 1-3 mm thick). The dielectric layer 1202 may be included, in some cases, to provide integrity and/or to strengthen the active antenna ceiling panel. In some embodiments, the dielectric layer 1202 may be omitted.

Above the dielectric layer 1202 is the ground plane layer 1120. As described above, the ground plane layer 1120 may be part of the ground plane assembly 1007, which may extend across a portion of or all of the ceiling of the floor 1000. The ground plane layer 1120, as well as the ground plane assembly 1007, may include any electrically conductive material or electromagnetically reflective material that may serve as a ground plane for a telecommunications system and which may reflect electromagnetic energy. Advantageously, the ground plane layer 1120 can block RF signals from reaching structures that are above the dielectric ceiling panel 1204 thereby reducing the occurrence of multipath interference.

In some cases, the ground plane layer 1120 is formed from the same material as the antennas 1104. In other cases, the ground plane layer 1120 may be formed from a different material. For example, the ground plane layer 1120 may be formed from copper, silver, aluminum, etc. In some cases, as with the antennas 1104, the ground plane layer 1120 may be created from metamaterials.

The various layers of the active antenna ceiling panel 1200 may be joined together using any method for joining one layer of a multi-layer panel structure to another layer of a multi-panel structure. For example, the layers of the active antenna ceiling panel 1200 may be joined using a non-metallic adhesive to create a single ceiling panel unit for installation. In other embodiments, a heat and pressure process may be applied to join the layers of the antenna ceiling panel 1200 together. Alternatively, a non-metallic staple or other joining structure may be used to join the layers of the antenna ceiling panel 1200. In some embodiments, different joining methods and structures may be used to join different layers of the active antenna ceiling panel 1200. For example, the dielectric layer 1202 may be applied as a laminate or a paint layer to the antenna layer 1102. While a non-metallic adhesive may be used to join the dielectric material ceiling panel 1204 to the antenna layer 1102.

The selection of materials for creating the antenna ceiling panel 1200 and for joining the various layers of the antenna ceiling panel 1200 together may be selected based on the wireless communication spectrum, cost, aesthetics, building structure, etc.

Example Ground Plane

Figure 13C:
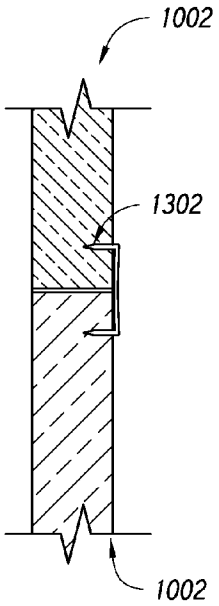
FIG. 13C is a detail view of a portion of one embodiment of the ground plane/RF shield circled in FIG. 13B.
Figure 13B:
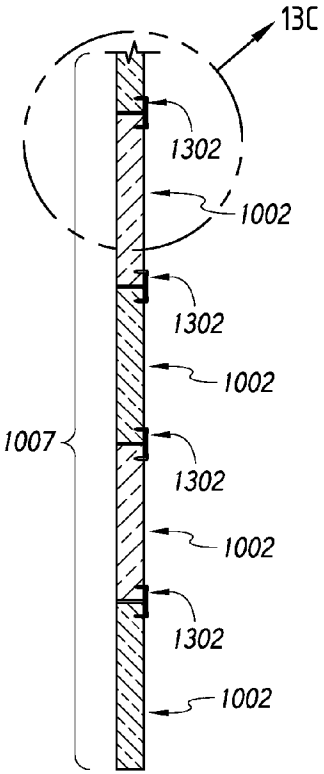
FIG. 13B is a cross-sectional view of one embodiment of the ground plane/RF shield of FIG. 13A taken along line 13B-13BA.
Figure 13A:
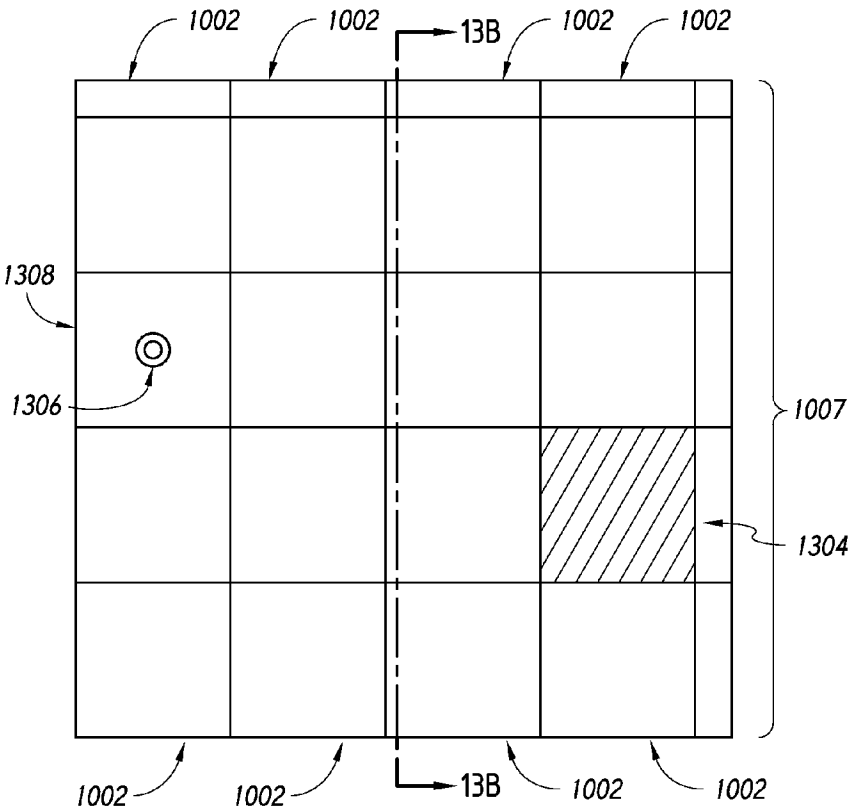
FIG. 13A is a plan view of one embodiment of a ground plane/RF shield included as part of a ceiling structure.

FIG. 13A is a plan view of one embodiment of a ground plane 1007 included as part of a ceiling structure (e.g., the ceiling structure 1012). The top surface of the ground plane 1007 may be constructed from a conductive or metallic material, such as aluminum, that may also be electromagnetically reflective thereby preventing RF signals from reaching structures that are above the ground plane 1007. In certain embodiments, by preventing RF signals transmitted to or from computing devices in the room below the ceiling structure 1012 from reaching structure above the ground plane 1007, multipath interference may be reduced. In some cases, the ground plane 1007 may be one large layer or sheet of the metallic material. However, as illustrated in FIG. 13A, in some cases, the ground plane 1007 may be created from a number of individual ground plane tiles 1002, which are each constructed from the metallic material.

In many cases, the ground plane 1007 may be constructed to cover an entire ceiling. In other words, in some cases, the ground plane 1007 may be coextensive with the ceiling. However, in other cases, while the ground plane 1007 may be substantially coextensive with the ceiling, gaps may be left for building features that require access to the room below the ceiling. For example, an HVAC vent 1304 may require access to the room below the ceiling. In such cases, a ground plane tile 1002 may be omitted from the space reserved for the HVAC vent 1304.

Not all building features that require access to the room below the ceiling require as much area as a ground plane tile 1002. For example, a sprinkler may require a smaller area of space than a ground plane tile 1002. In some cases, a ceiling tile other than a ground plane tile may be used in tile-sized portions of the ceiling that include the sprinkler, or other building feature requiring access to the room below the ceiling. However, in other cases, a modified ground plane tile 1308 that includes a port or opening 1306 may be included with the ground plane 1007. The port 1306 permits access to the building feature (e.g., the sprinkler) through the ground plane 1007. The port 1306 may, in some cases, be surrounded by an insulator or a dielectric material that provides a buffer between the ground plane 1007 and the building feature that extends through the port 1306.

As previously stated, in some cases, the ground plane 1007 may be manufactured as one large structure. However, in embodiments where the ground plane 1007 is created from a number of ground plane tiles 1002, each of the ground plane tiles 1002 may be joined together using one or more joining methods and/or apparatuses. FIG. 13B is a cross-sectional view of one embodiment of the ground plane 1007 of FIG. 13A taken along line 13B-13B that illustrates one example of a joining method that uses staples 1302. FIG. 13C is a detail view of the circled portion of the ground plane 1007 of FIG. 13B. As illustrated in FIG. 13B and FIG. 13C, each ground plane tile 1002 may be joined with a neighboring ground plane tile 1002 using a staple 1302. The staple 1302 may be created from the same metallic material used to create the ground plane tile 1002. In some cases, the staple 1302 may be created from a different material than the ground plane tile 1002 because, for example, of strength requirements or cost purposes.

In some embodiments, the staple 1302 goes through the entire ground plane tile 1002. In other cases, the staple 1302 may not go through the entire thickness of the ground plane tile 1002. In some embodiments, the staple 1302 may combine multiple layers used in creating a ceiling tile. For example, the staple 1302 may be used to join all the layers of an antenna ceiling panel 1200 together, including a ground plane layer 1120, as well as joining the ground plane layer 1120 to the ground plane tile 1002 as part of the ground plane 1007.

As an alternative, or in addition, to the staple 1302, the ground plane tiles 1002 may be joined together by slotting the ground plane tiles 1002 into a support structure in the ceiling that serves as a frame for the ceiling. The support structure may be metallic to maintain the connection between the ground plane tiles 1002. Alternatively, or in addition, the support structure may be sized and/or configured such that the ground plane tiles 1002 are maintained in contact with each other when installed with the support structure. In some such cases, the support structure may or may not be created from a metallic or conductive material. Further, in some cases, clips or suction apparatuses may be used to join the ground plane tiles 1002.

Example Ground Plane Ceiling Panel Assembly

Figure 14:
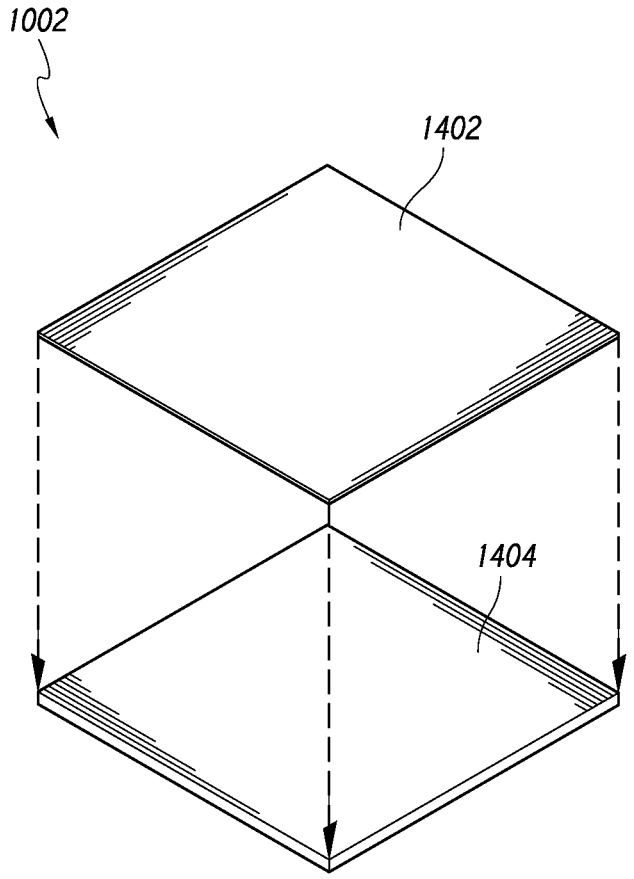
FIG. 14 is an assembly view of parts of an embodiment of a ground plane ceiling panel.

FIG. 14 is an assembly view of parts of an embodiment of a ground plane ceiling panel or ground plane tile 1002. The ground plane tile 1002 may be created from the combination of a metallic ground plane layer 1402 that is the top layer of the ground plane tile 1002 and a dielectric layer 1404 that is the bottom layer of the ground plane tile 1002 and that faces the floor of a room.

As with the layers of the active antenna ceiling panel 1200, the layers of the ground plane tile 1002 may be joined using a variety of methods and joining structures. For example, the layers may be joined using a metallic or non-metallic-based adhesive. As another example, the layers may be joined using a staple. In some cases, the staple used to join the layers of the ground plane tile 1002 may be the staple 1302 used to create the ground plane 1007. In other cases, the staple used to join the layers of the ground plane tile 1002 may be a different staple, which may or may not be made from the same material, as the staple 1302.

The ground plane layer 1402 may be created from the same material as the ground plane layer 1120 of the active antenna ceiling panel 1200. Further, the ground plane layer 1402 may be joined and/or in electrical communication with the ground plane layer 1120/1402 of one or more neighboring tiles.

The dielectric layer 1404 may include any type of dielectric material. Generally, the dielectric layer 1404 may be formed from the same material as the dielectric ceiling panel 1204. However, in some embodiments, the dielectric layer 1404 may be formed from a different material. In some embodiments, the dielectric layer 1404 may be of a different thickness than the dielectric ceiling panel 1204. Similarly, in some embodiments, the ground plane layer 1402 may of a different thickness than the ground plane layer 1120. For example, in some cases, the difference in thickness may be to maintain a consistent thickness between the ground plane tile 1002 and the active antenna ceiling panel 1200, which includes a different number of layers.

Example Ceiling Assembly

Figure 15:
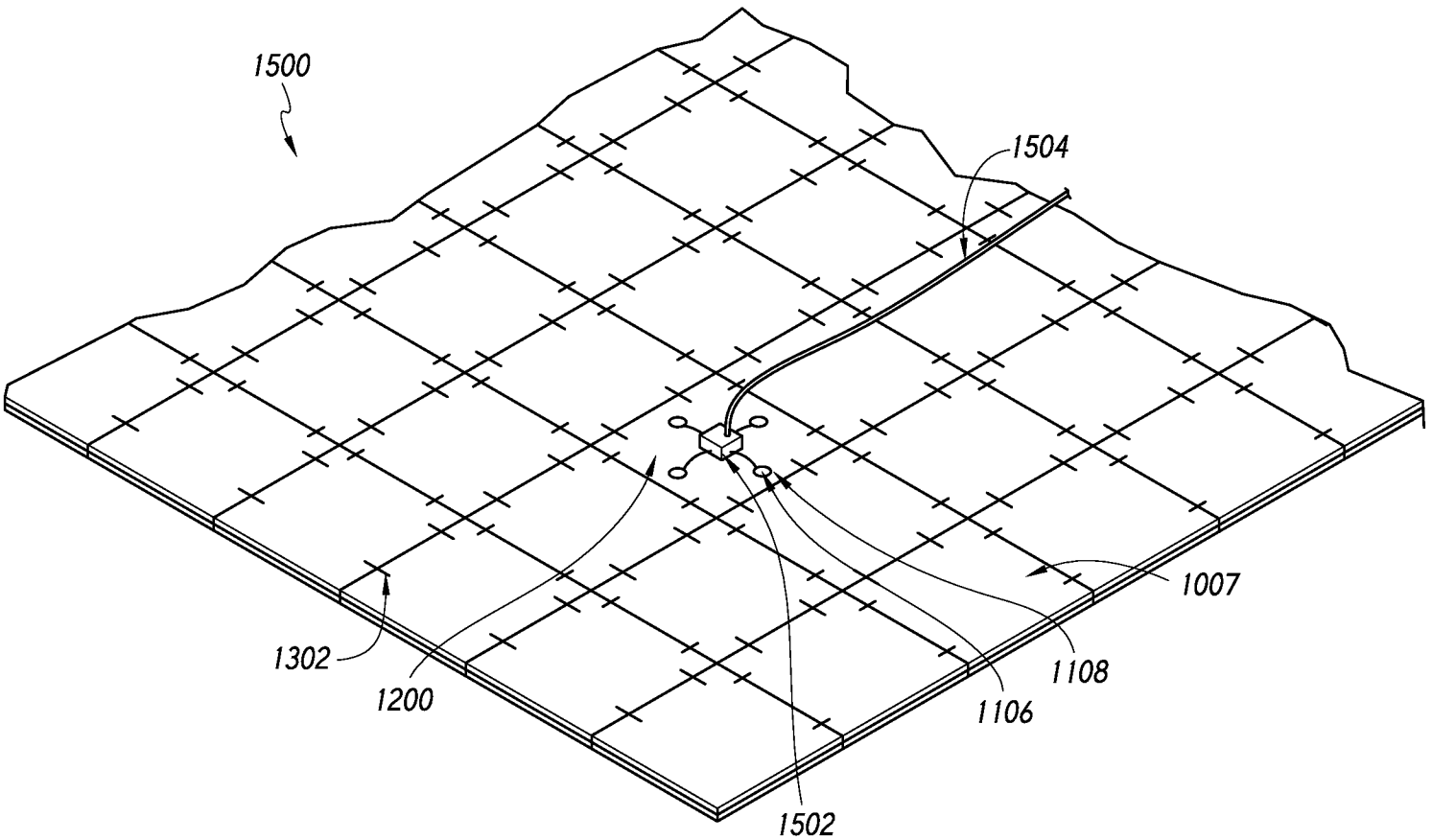
FIG. 15 illustrates an embodiment of a ceiling assembly including an active antenna ceiling panel and RF ground plane/RF shield panels.

FIG. 15 illustrates an embodiment of a ceiling assembly 1500 including an active antenna ceiling panel 1200 and a ground plane 1007. The view illustrated in FIG. 15 is from above the ceiling assembly 1500. In other words, the side of the ceiling assembly 1500 that is not viewable from inside the room.

As illustrated in FIG. 15, the ceiling assembly 1500 may include a number of ground plane tiles that are joined together with staples 1302 to create the ground plane 1007. Further, the ground plane 1007 may be joined to an active antenna ceiling panel 1200 via the staples 1302. Although a single active antenna ceiling panel 1200 is illustrated, it should be understood that a number of active antenna ceiling panels 1200 may be included in the ceiling assembly 1500 creating a type of distributed antenna system (DAS).

As previously described, the active antenna of the active antenna ceiling panel 1200 may include antenna connectors 1106 connected to the ground plane via the metal cups 1108. These antenna connectors 1106 may be connected to a splitter or power divider 1502. Although termed a power divider, the power divider 1502 may, in some cases, include additional equipment. For example, the power divider 1502 may include a combiner for combining signals received from a plurality of antennas included in the active antenna ceiling panel 1200. Signals sent/received from the antennas of the active antenna ceiling panel 1200 may be received from/sent to the building's wireless communications distribution equipment (not shown) along a communications medium or feedline 1504 (e.g., an Ethernet cable) to provide access to wireless communications within the room below the ceiling assembly 1500. Further, the power divider 1502 may also include, in some embodiments, a bidirectional amplifier. In cases where the DAS includes multiple active antenna ceiling panels 1200, each of the active antenna ceiling panels 1200 may be in electrical communication with a separate feedline 1504. The separate feedlines 1504 may connect to a combiner before being fed to the building's wireless communication distribution equipment. Alternatively, or in addition, the feedlines 1504 may be in electrical communication with one or more routers, switches, hubs, or other networking equipment that may process RF signals from multiple inputs.

Although not illustrated, in some embodiments, access to power may be provided above the ceiling assembly 1500. This power access enables power to be supplied to equipment connected to the active antenna ceiling panel (e.g., the power divider 1502, a router, lighting, etc.).

Advantageously, in certain embodiments, the installation of the ceiling assembly 1500 with the ground plane 1007 and the active antenna ceiling panel 1200 may improve wireless communications in a building by amplifying wireless communications signals received by and transmitted by the active antenna ceiling panel 1200 as well as by reducing multipath interference. Further, the installation of the ceiling assembly 1500 can reduce the costs of creating a wireless network because, for example, the wireless antennas may be pre-built into the building during construction as part of the ceiling. Further, the amount of equipment required to create a building-wide network is reduced due to the reduction in signal interference caused by metallic structures (e.g., HVAC, sprinklers, etc.) often built into buildings.

Example Building Installations

Figure 16:
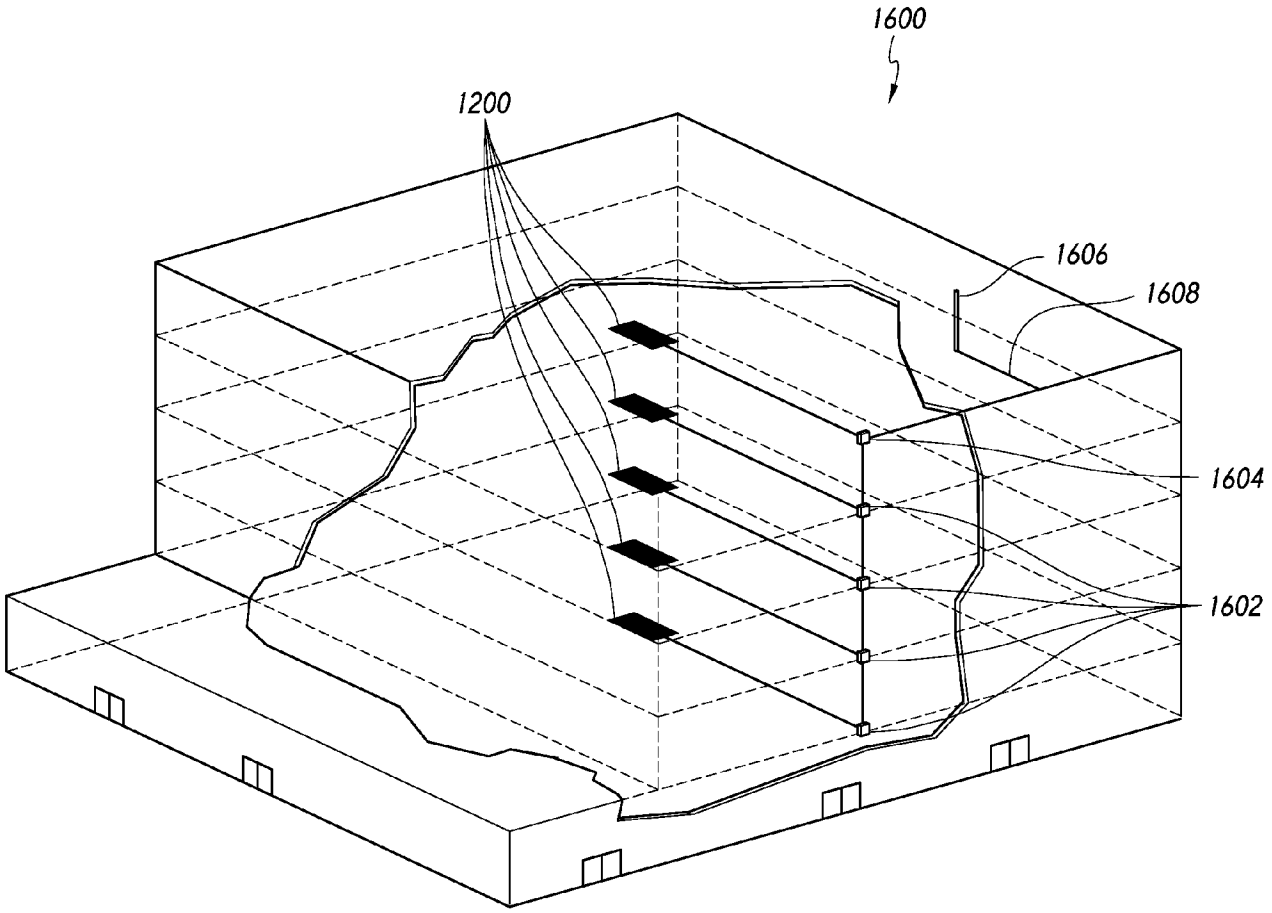
FIG. 16 illustrates an embodiment of a building with an embodiment of an active antenna communications assembly.

FIG. 16 illustrates an embodiment of a building with an embodiment of an active antenna communications assembly 1600. The active antenna communications assembly can include a donor antenna 1606 configured to receive wireless communication signals from a communications provider. For example, the donor antenna 1606 may receive signals from a cellular communications provider. Further, the donor antenna 1606 may transmit signals received from within the building by the active antenna ceiling panels 1200. In some embodiments, the donor antenna 1606 may include a number of antennas. Some of the antennas may be configured for use with one cellular communications provider and another set of antennas may be configured for use with a different cellular communications provider.

Signals received and/or sent from the donor antenna 1606 may be amplified by a bidirectional amplifier 1604 in communication with the donor antenna 1606 via RF cabling or a feedline 1608. After a signal received from the donor antenna 1606 has been amplified by the amplifier 1604, the amplified signal may be provided to one or more splitters 1602 which may then pass the signal to the active antenna ceiling panels 1200.

In some embodiments, the feedline 1608 may run from donor antenna 1606 to a central communications equipment location (e.g., a wireless equipment closet or basement). This location may include one or more pieces of communications equipment for amplifying, repeating, splitting, joining, or otherwise processing distributing RF signals between the donor antenna 1606 and the active antenna tiles 1200. For example, the location may include the bidirectional amplifier 1604 and the splitters 1602. Further, the location may include one or more communication head-end units, such as a fiber distribution head-end unit.

Although not explicitly shown for ease of illustration, it should be understood that the active antenna ceiling assembly 1600 may further include a ground plane 1007 as part of each floor's ceiling within the building. Advantageously, the active antenna communications assembly 1600 can provide cellular communication to buildings that may have poor cellular reception due to the size of the building or the conductive materials used in the construction of the building creating a Faraday cage or shield. Further, in some embodiments, the active antenna communications assembly 1600 may provide improved network performance for wireless networks, cellular or otherwise, by reducing multipath interference.

Figure 17:
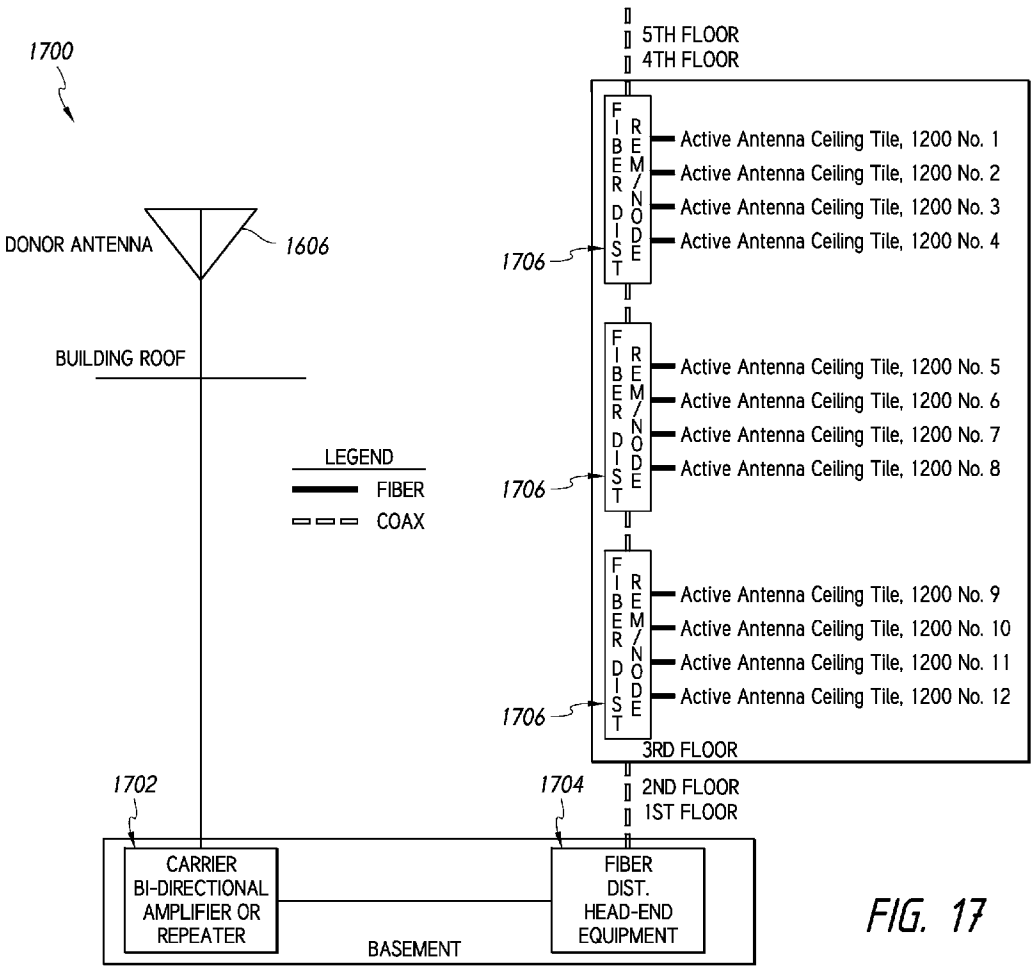
FIG. 17 illustrates another embodiment of a building with an active antenna communications assembly.

FIG. 17 illustrates another embodiment of a building with an active antenna communications assembly 1700. Similar to the system illustrated in FIG. 16, the active antenna communications assembly 1700 includes a donor antenna 1606 on the roof of the building. It should be understood that the donor antenna 1606 may be located on any portion of the building and, generally, the donor antenna 1606 will be placed in a location that is optimal or near-optimal for receiving a signal from a communications provider (e.g., a cellular communications provider, a satellite service provider, etc.). Further, in some embodiments, the donor antenna 1606 may be omitted. In some such embodiments, access to a communications service, such as access to the Internet or other network, may be provided by a wired connection to the building.

The donor antenna 1606 may be used to connect one or more external communication systems (e.g., communications service providers, such as Internet Service Providers or cellular communications providers) to the internal communications system. The internal communications system may include an internal network (e.g., an intranet) and/or a system for improving cellular communications within the building.

In the embodiment illustrated in FIG. 17, the donor antenna 1606 is connected via a coaxial cable to a bidirectional amplifier and/or repeater 1702 configured to boost or amplify a signal received from the donor antenna 1606. Further, the bidirectional amplifier 1702 may be configured to amplify a signal before it is transmitted via the donor antenna 1606 to an external communications system (e.g., a cellular communications tower associated with a cellular communications provider).

The bidirectional amplifier 1702 may provide the amplified signal to an internal communications distribution system. This internal communications distribution system can include any system for distributing communications access throughout the building. For example, in the embodiment illustrated in FIG. 17, the internal communications distribution system includes a fiber distribution head-end equipment system 1704, a number of fiber distribution remote nodes 1706, and a number of active antenna ceiling panels 1200.

The fiber distribution head-end equipment system 1704 can include any system for receiving the amplified RF signal from the bidirectional amplifier 1702 and outputting the signal along a fiber optical network. In some embodiments, the fiber distribution head-end equipment system 1704 may modify the signal received from the bidirectional amplifier 1702 to optimize the signal for transmission over the fiber optical network. A reverse process may be performed by the fiber distribution head-end equipment system 1704 before providing a signal for transmission to the bidirectional amplifier.

The RF signals output by the fiber distribution head-end equipment system 1704 are provided to the fiber distribution remote nodes 1706. As illustrated in FIG. 17, a floor may have a number of fiber distribution remote nodes 1706, which are configured to provide the RF signal to a number of active antenna ceiling panels 1200. In some embodiments, multiple floors may share a fiber distribution remote node 1706. The number of fiber distribution nodes 1706 and active antenna ceiling panels 1200 is generally application-specific and may be based on the size of the building, the types of antennas included in the active antenna ceiling panels 1200, and/or the communication frequencies utilized by the communications system. Although not depicted, in some embodiments, additional bidirectional amplifiers may exist between, or as part of, the remote fiber distribution nodes 1706.

Second Example Active Antenna Layer

Figure 18:
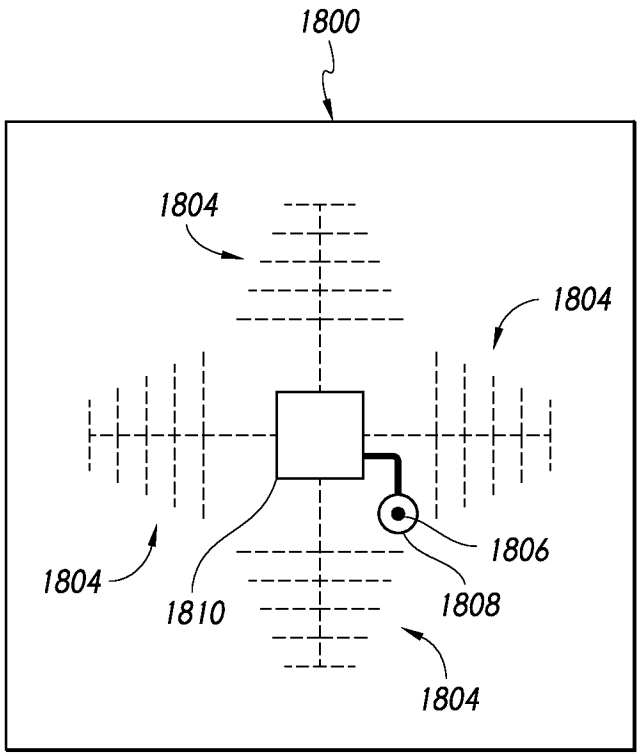
FIG. 18 illustrates another example of an active antenna layer for an active antenna ceiling panel.

FIG. 18 illustrates another example of an active antenna layer 1800 for an active antenna ceiling panel (e.g., the active antenna ceiling panel 1200). The active antenna layer 1800 may include a number of antennas 1804. The antennas 1804 may include one or more of the embodiments described with respect to the antennas 1104. Further, as with the antennas 1104, the antennas 1804 may include any type of antenna that may be used to facilitate wireless communication. The choice of antenna type may be based on the desired application. For example, the antennas 1804 may be log periodic antennas to support wide band applications. Alternatively, the antennas 1804 may be Yagi antennas to support directionality and high gain.

Further, the antenna layer 1800 may include a power divider 1810. The power divider illustrated in FIG. 18 is a 4-way power divider. However, the power divider 1810 is not limited as such. In some embodiments, the power divider may be an n-way power divider, where n is the number of antennas included on the active antenna layer 1800. In other cases, n may differ from the number of antennas. For example, the power divider may be and n/2 power divider where n is the number of antennas included on the active antenna layer 1800.

The power divider 1810 may be configured to split a RF signal received from an RF connector 1806 and provide the split signal to each of the antennas 1804. In some embodiments, the power divider may be a separate unit mounted on the antennas layer 1800, or above the ground layer with a direct feed to the antennas 1804. However, in certain embodiments, the power divider 1810 may be created on the antenna layer 1800 using conductive traces. Advantageously, by creating the power divider on the antenna layer with conductive traces, the thickness and cost of the active antenna ceiling panels 1200 may be reduced.

In some embodiments, the power divider 1810 may be bidirectional. In such embodiments, the power divider 1810 may also serve as a power combiner configured to combine signals received from the antennas 1804. The combined signal may be provided via a feedline to, for example, a fiber distribution remote node 1706, an amplifier (e.g., the bidirectional amplifier 1604), a donor antenna, or any other system that may be included as part of the communications network in the building In some embodiments, the signal may be provided to a router or other network equipment. In some such cases, the antennas 1804 may replace the antennas that are often incorporated as part of a wireless router.

While the antenna layer 1102 included a connector 1106, and connection to ground via the metallic cup 1108, for each antenna 1104, the antenna layer 1800 includes a single RF connector 1806 with a single ground connector 1808 to the ground plane for the RF connector 1806. As with the metallic cup 1108, the ground connector 1808 may also be a metallic cup. However, in some cases, the ground connector 1808 may be formed from an alternative structure. For instance, in some cases, the RF connector 1806 may extend through a via that is coated with a conductive material that is configured to maintain an electrical connection with the RF connector 1806.

In certain embodiments, the antenna layer 1800 only includes a single RF connector 1806 because the RF signal may be divided or combined by the power divider 1810 included as part of the antenna layer 1800. Advantageously, in certain embodiments, the reduction in RF connectors may make manufacture simpler and reduce the cost of creating the active antenna ceiling panels. In some embodiments, the antenna layer 1800 may include multiple power dividers 1810, each with its own RF connector 1806 and ground connector 1808. Each of the power dividers 1810 may be in electrical communication with a subset of antennas 1804 of the antenna layer 1800.

Second Example Ceiling Assembly

Figure 19:
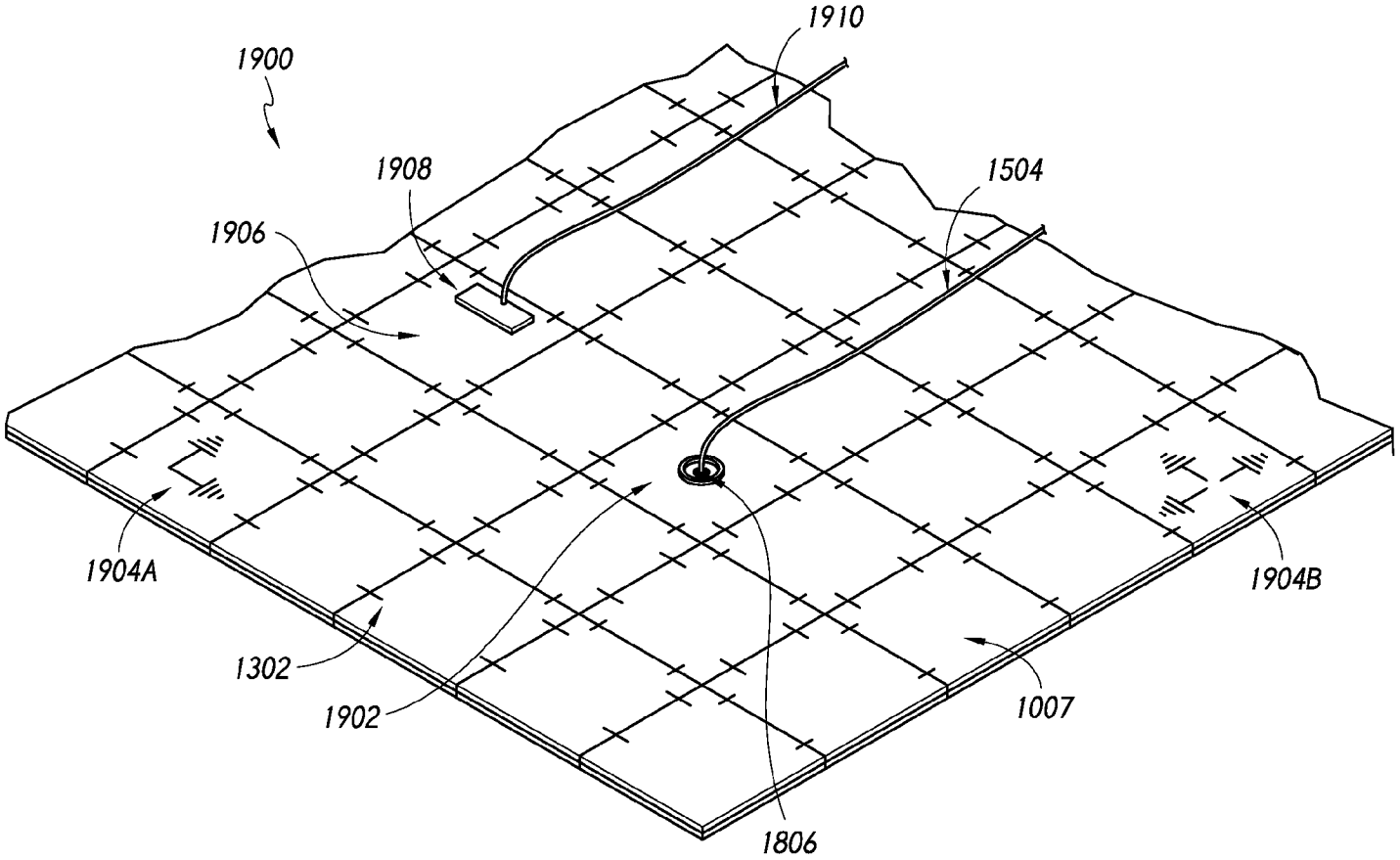
FIG. 19 illustrates an embodiment of a ceiling assembly including active antenna ceiling panels, passive antenna ceiling panels, and an RF ground plane.

FIG. 19 illustrates an embodiment of a ceiling assembly 1900 including active antenna ceiling panels 1902 and 1906, passive antenna ceiling panels 1904A and 1904B (collectively referred to as passive antenna ceiling panels or tiles 1904), and an RF ground plane 1007. Further, although not illustrated, the ground plane 1007 of FIG. 19 may include openings or spaces within the ground plane 1007 to accommodate access to structures located above the ceiling assembly 1900.

As with the ceiling assembly 1500, each of the ground plane tiles constituting the ground plane 1007 may be joined using staples 1302. Further, the active antenna tiles 1902, 1906 and the passive antenna tiles 1904 may also be joined to the ground plane 1007 via the staples 1302. Alternatively, or in addition, a number of other joining mechanisms may be utilized to join the tiles of the ground plane 1007 and/or the various antenna tiles together as previously described with respect to FIGS. 13B and 13C. For example, a conductive support structure may be utilized to join the tiles. As a second example, a clamp, such as the clamp described below with respect to FIG. 26, may be utilized.

In some embodiments, at least some of the tiles (e.g., ground plane tiles 1002, active antenna tiles, passive antenna tiles, etc.) may be joined using conductive hinges to enable a user to open a portion of the ceiling assembly 1900 so as to access components installed on top of tiles (e.g., a wireless router 1908) and/or structures above the ceiling assembly 1900 (e.g., HVAC systems, electrical systems, etc.). In other embodiments, a joining mechanism may be omitted because, for example, the ceiling assembly may be constructed as a single unit. For instance, in some cases, the ground plane 1007, inclusive or exclusive of the antenna tiles, may be formed as a single sheet sized to cover an entire ceiling, or a portion of a ceiling designed to be covered with the ground plane 1007.

The active antenna tile 1902 may be configured to provide access to a cellular communications network. In certain embodiments the active antenna tile 1902 is connected to a donor antenna that is external to the building housing the active antenna tile 1902. By connecting the active antenna tile 1902 to the donor antenna, improved cellular communications may be provided to users in the building. Although a single active antenna tile 1902 is illustrated, it should be understood that multiple active antenna tiles 1902 may be distributed throughout the ceiling assembly 1900 with each active antenna tile 1902 in communication with the donor antenna.

In some instances, the active antenna tile 1902 may connect to the donor antenna via a feedline 1504. However, in most cases, one or more devices may be electrically connected between the active antenna tile 1902 and the donor antenna. For example, a bidirectional amplifier may be electrically connected between the active antenna tile 1902 and the donor antenna. Further, one or more pieces of distribution equipment (e.g., a fiber distribution remote node, a fiber distribution head-end system, one or more switches, etc.) may be electrically connected between the active antenna tile 1902 and the donor antenna.

The active antenna tile 1906 may be configured to provide access to a wireless communications network. This wireless communications network may be for an intranet or to provide access to an external network connection, such as the Internet. As illustrated in FIG. 19, the active antenna tile 1906 may include a wireless router 1908. This wireless router 1908 may be integrated or embedded into the active antenna tile 1906. For example, the wireless router 1908 may be included as part of the PCB of the antenna layer (e.g., antenna layer 1800) of the active antenna tile 1906. Alternatively, the wireless router 1908 may be a separate device that is installed or mounted above the active antenna tile 1906 and which can connect to a connector (e.g., the connector 1808) of the active antenna tile 1906. In some embodiments, the antennas of the active antenna tile 1906 serve as the antennas for the wireless router 1908.

As illustrated in FIG. 19, the active antenna tile 1906, via the mounted or embedded wireless router 1908 may connect to a feedline 1910 (e.g., an Ethernet cable). The feedline 1910 may connect with a wall socket, which may provide external access to a network (e.g., the Internet). Alternatively, the feedline 1910 may connect with additional networking equipment, such as a switch, hub, or another router.

In some cases, the active antenna tile 1906 and active antenna tile 1902 may include the same type or design of antennas as part of their respective antenna layers. However, often the active antenna tile 1906 and the active antenna tile 1902 will include different antenna types or designs to accommodate different frequency ranges. Advantageously, by including active antenna tiles with different antennas, the ceiling assembly 1900 may support the operation of multiple networks (e.g., one or more different wireless intranets, one or more cellular phone networks, etc.). In embodiments where the active antenna tiles support the same set of frequencies, one or more backend systems (e.g., routers) may identify data intended for the communications network associated with the active antenna tile 1902 versus data intended for the communications network associated with the active antenna tile 1906 based, for example, on data packet metadata.

In addition to the active antenna tiles, the ceiling assembly 1900 may include a number of passive antenna tiles or passive repeaters 1904. In some cases, the passive antenna tiles 1904 may have different antenna configurations from the active antenna tiles. For example, the passive antenna tile 1904A includes two antennas at a 90 degree angle and the passive antenna tile 1904B includes three antennas. In other cases, each of the passive antenna tiles 1904 may have the same antenna configuration as one of the active antenna tiles. However, unlike the active antenna tiles, the passive antenna tiles 1904 may omit a connection to additional networking or communications equipment. In some embodiments, some of the passive antenna tiles 1904 may have an antenna configuration that supports a set of frequencies supported by the active antenna tile 1902, and some of the passive antenna tiles 1904 may have an antenna configuration that supports a set of frequencies supported by the active antenna tile 1906. Each of the supported set of frequencies may differ. However, in some cases, there may be at least partial overlap between the supported frequencies.

The passive antenna tiles 1904 may radiate or cause RF signals to meander across the ceiling assembly 1900. Advantageously, in certain embodiments, the passive antenna tiles 1904 increase the range of wireless communication by acting as a passive repeater of RF signals that encounter the passive antenna tiles 1904.

As illustrated in FIG. 19, the active antenna tiles 1902, 1906, and the passive antenna tiles 1904 may be of the same size or area. Further, the antenna tiles may be of the same size or area as each of the ground plane tiles (e.g., ground plane tiles 1002) that make up the ground plane 1007. In some embodiments, one or more of the antenna tiles may be of a different size or area than the ground plane tiles that make up the ground plane 1007.

In some embodiments, the ratio of active antenna tiles to ground plane tiles may be greater than or equal to 8 to 1. In other embodiments, the ratio of active antenna tiles to ground plane tiles may be selected based on the type of active antenna tile, the size of the ceiling or building, the number of tile omissions (e.g., due to HVAC vents or lights), the number of passive antenna tiles included, the type of communications network that includes the active antenna tiles, and any other factor that may determine a ratio of ground plane tiles to active antenna tiles. In some cases, the ratio of active antenna tiles to ground plane tiles may be less than 8 to 1 because, for example, active antenna tiles designated for different communications networks may be located near or adjacent to each other. In some cases, the ration of active antenna tiles to ground plane tiles may be 20 to 1, 50 to 1, 100 to 1, or more.

The ceiling assembly 1900 may be a portion of a ceiling for a building with a floor plan of at least 20,000 $ft^2$ per floor or at for at least some of the floors. In some embodiments, the ceiling structure 1900 may be for a portion of a ceiling for a building with a floor plan of at least 50,000 $ft^2$ per floor or for at least some of the floors. In other embodiments, the ceiling structure 1900 may be a portion of a ceiling for a building with a floor plan that is at least 100,000 $ft^2$ per floor or at for at least some of the floors.

Advantageously, in certain embodiments, a plurality of passive antenna tiles and active antenna tiles may be positioned throughout a ceiling to maintain and enhance wireless communication throughout a floor or a building. Further, the inclusion of the ground plane in the antenna tiles as well as around the antenna tiles may reduce interference from conductive elements that may exist above the ceiling. Moreover, the ground plane, as illustrated in FIG. 20, improves the range of the antennas providing for improved coverage compared structures that do not implement a ground plane in the ceiling.

Figure 20:
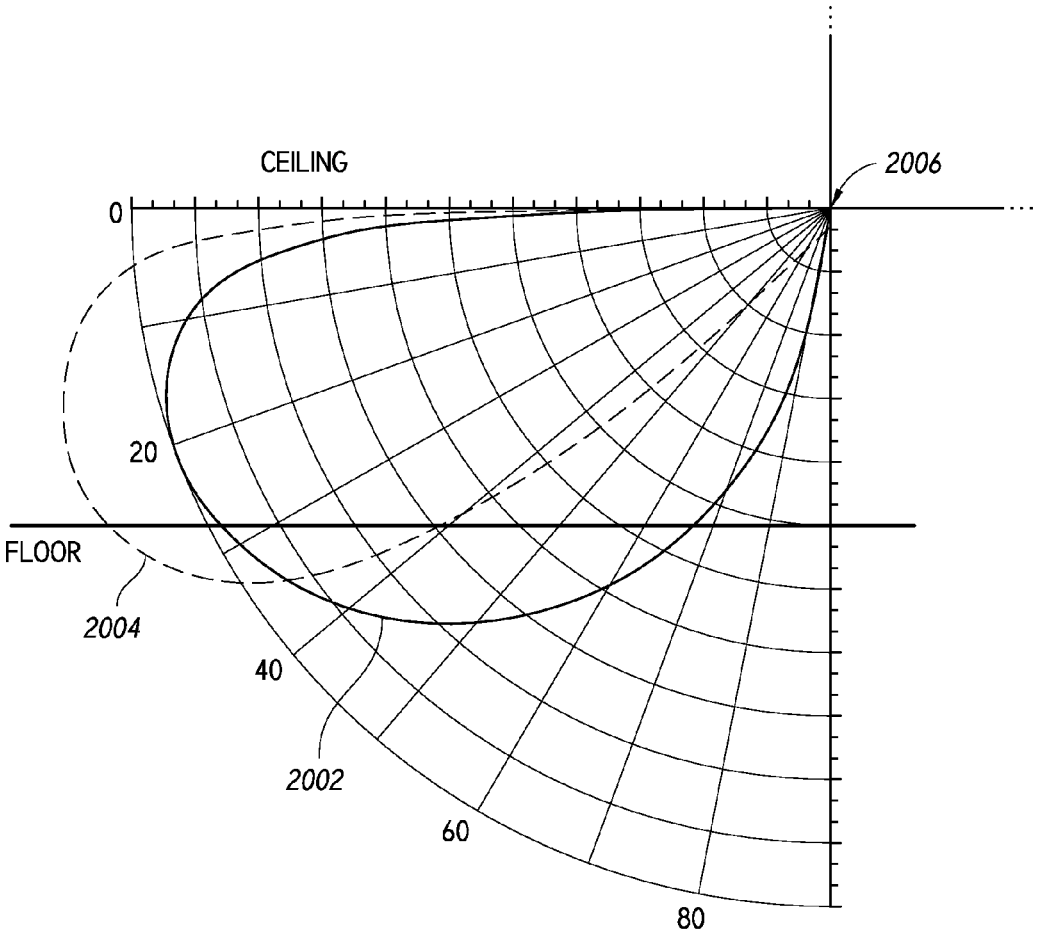
FIG. 20 illustrates a graph of signal propagation from one lobe of a ceiling antenna tile with and without a ground plane installed across the ceiling.

FIG. 20 illustrates a graph of signal propagation from one lobe of a ceiling antenna tile with and without a ground plane installed across the ceiling. The graph 2002 illustrates the signal propagation from the ceiling antenna without the ground plane. The origin 2006 of the signal is at the center of a power divider included as part of the ceiling antenna. The graph 2004 illustrates the signal propagation from the ceiling antenna with a ground plane. As can be seen from the graph 2004, the ground plane causes the signal to meander further along the ceiling resulting in a greater range compared to the antenna tile in the ceiling without the ground plane.

Example Communication Networks

Figure 21:
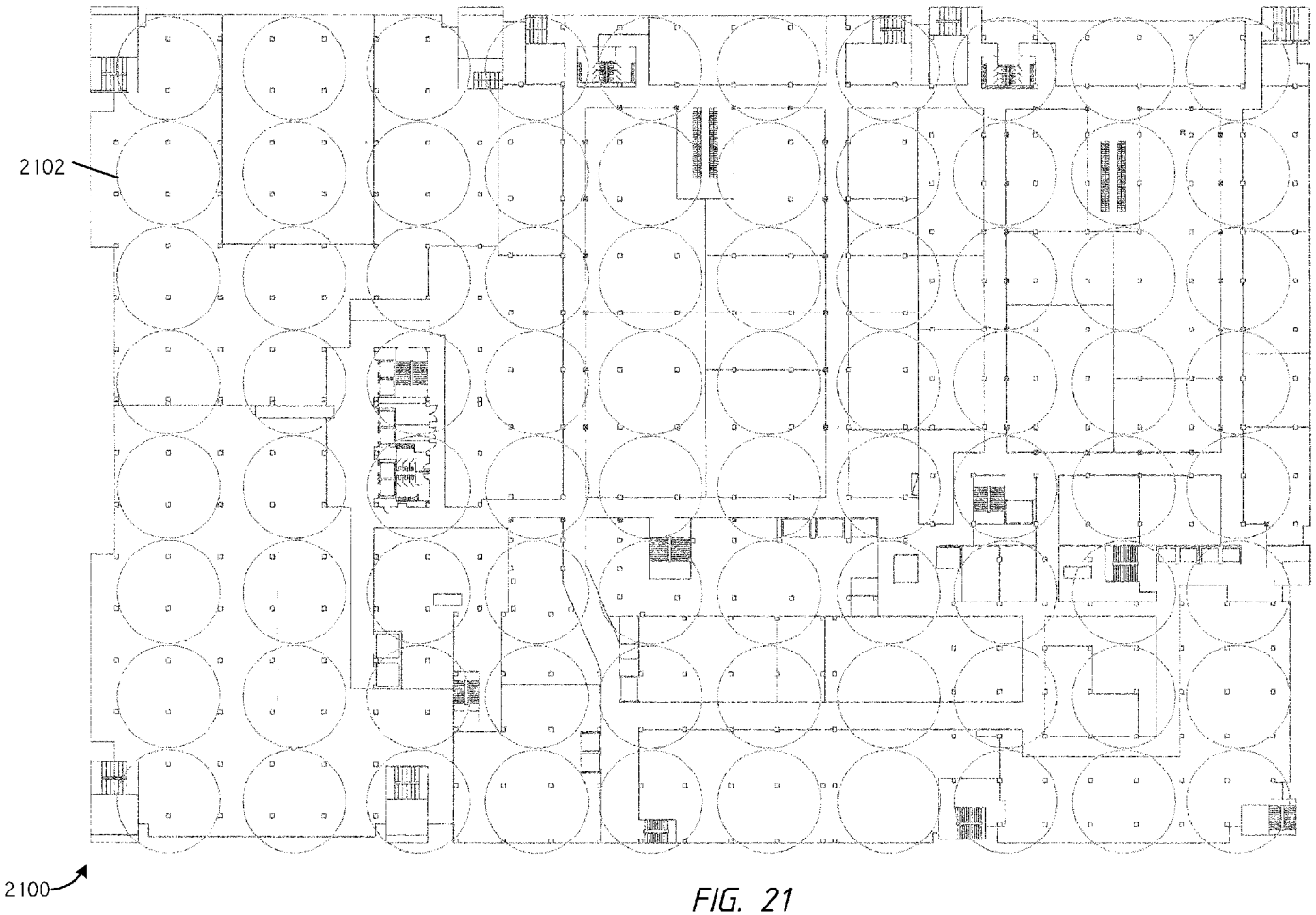
FIG. 21 illustrates a floor plan of one floor of a building with a number of WiFi routers.
Figure 22:
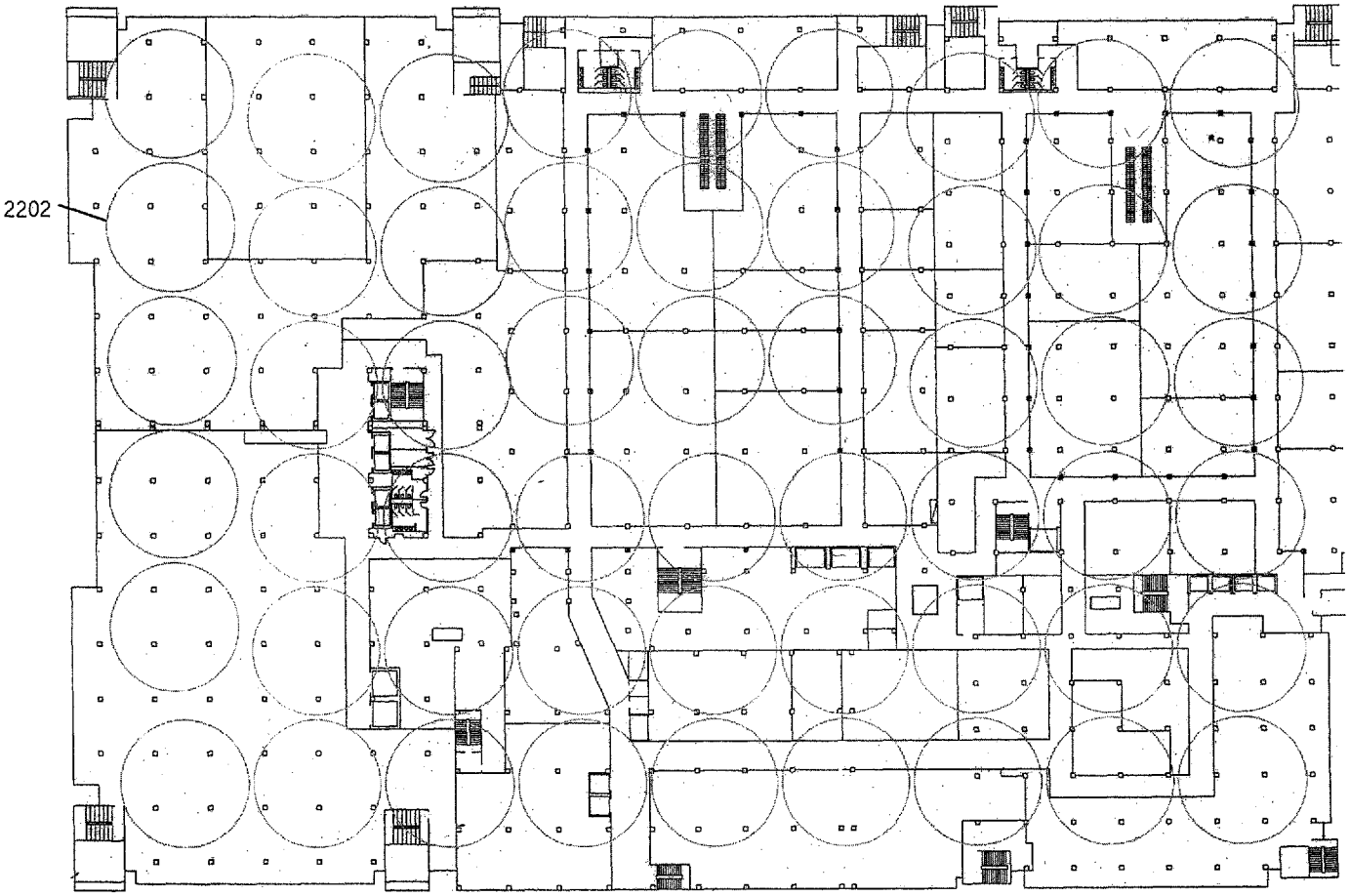
FIG. 22 illustrates a floor plan of the floor of the building from FIG. 21 with a number of femtocells.
Figure 23:
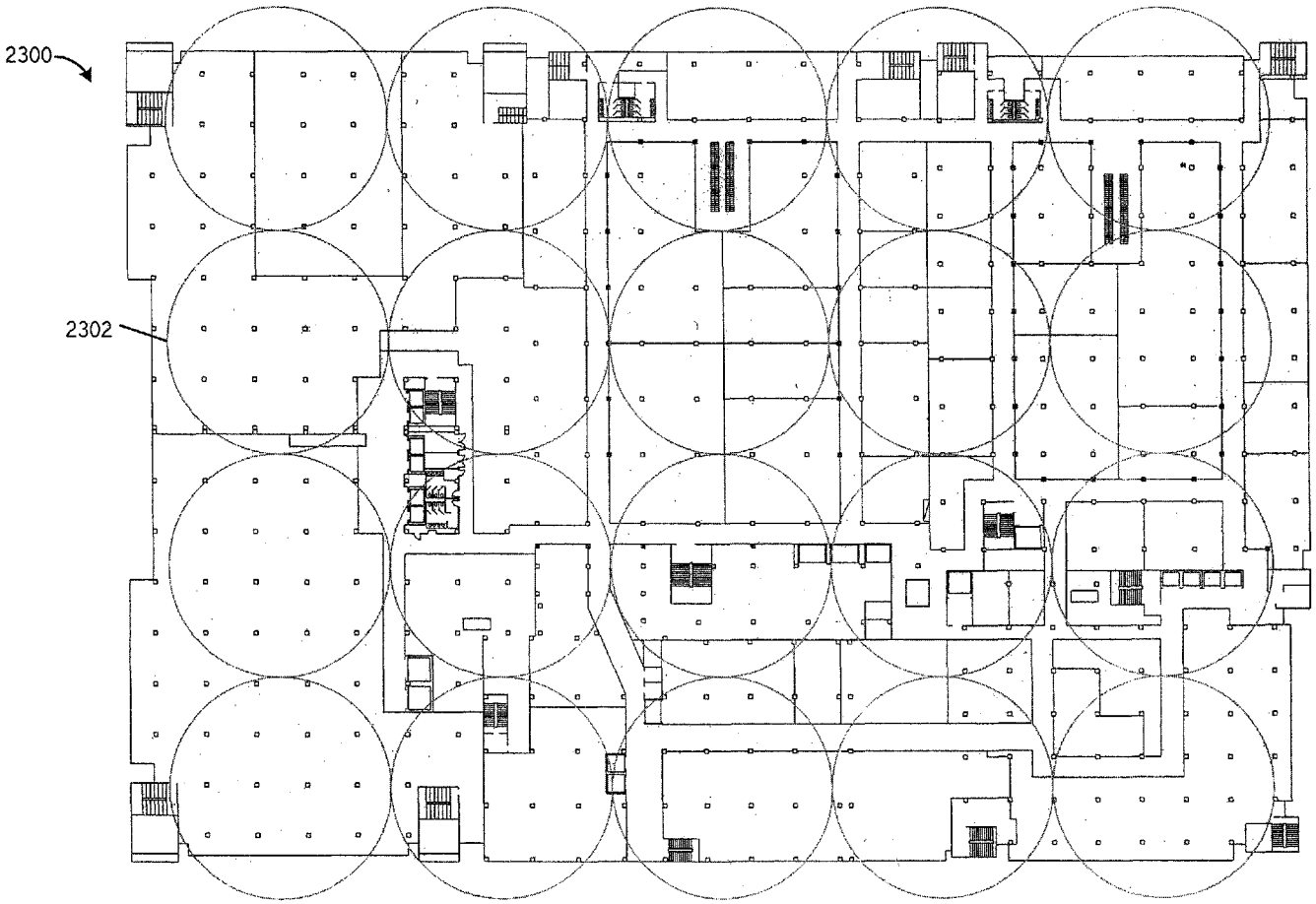
FIG. 23 illustrates a floor plan of the floor of the building from FIG. 21 with a number of active antenna tiles.

To illustrate the difference between the installation of active antenna tiles (e.g., the active antenna tiles 1200, 1902, etc.), wireless routers for a wireless network, and femtocells for a cellular communications network, an example floor plan is illustrated in FIGS. 21-23. Each of the floor plans represents the same floor of a real 14 story building built with concrete floors and walls. The illustrated floor plan is for a floor that has an area of is approximately 200,000 $ft^2$.

FIG. 21 illustrates a floor plan 2100 of one floor of the building with a number of wireless routers 2102. The wireless routers 2102 are positioned in an attempt to provide coverage throughout the floor. While the coverage area of different routers differs, typically the range of a wireless router is approximately between 2,500 $ft^2$ and 4,000 $ft^2$.

Assuming such a range for each wireless router 2102, the floor plan 2100 would require between 50 and 80 routers 2102 to provide wireless network coverage throughout the floor.

It is likely that large portions of a floor that is 200,000 $ft^2$ will lack access to a cellular communications network. One method of expanding cellular phone coverage is through the installation of femtocells, which serve as small base stations for improving indoor coverage of cellular networks. FIG. 22 illustrates a floor plan 2200 of the floor of the building from FIG. 21 with a number of femtocells 2202 to provide cellular phone coverage throughout the building. The typical range of a femtocell is 10 meters or roughly 32.8 ft. Although, some providers have advertised a range of 40 feet for their femtocells or approximately an area of 5000 $ft^2$. Assuming the 5000 $ft^2$, the floor plan 2200 would require approximately 40 femtocells 2202 to provide cellular phone coverage throughout the floor.

FIG. 23 illustrates a floor plan 2300 of the floor of the building from FIG. 21 with a number of active antenna tiles 2302. The active antenna tiles 2302 can include some or all of the embodiments described with respect to the active antenna tiles herein (e.g., the active antenna ceiling panel 1200, 1902, etc.). The active antenna tiles can cover a variety of ranges based on the type of antenna selected and the frequency ranges. In some embodiments, each active antenna tile can cover a range of 10,000 $ft^2$. This range was determined based on real world testing of an antenna tile. This testing is described below with respect to FIG. 24. With a range of 10,000 $ft^2$, the floor plan 2300 would require 20 active antenna tiles 2302. Thus, as can be seen from floor plan 2300, in some cases less active antenna ceiling tiles are required to provide coverage throughout the floor than wireless routers or femtocells, which can reduce purchase and maintenance costs. In some embodiments, the range of the antenna tile may be greater than 10,000 $ft^2$. In some embodiments, the use of a ground plane that extends across a ceiling, or a significant portion of a ceiling, may extend the range of the antenna tile due, for example, to a meandering effect of the ground plane on RF signals.

Further, in certain embodiments, the active antenna ceiling tiles may include different antennas configured to support different services. Thus, in some cases, an active antenna tile 2302 may be used for both wireless and for cellular communications further reducing the costs compared to the installation of both routers 2102 and femtocells 2202 to provide both wireless networking and cellular communications access throughout the floor. To separately install wireless routers 2102 and femtocells 2202, between 90 and 120 systems would be needed. Using active antenna tile 2302 that include antennas for both wireless communications and cellular communications, 20 systems can be installed. Alternatively, if separate active antenna tiles 2302 are installed for wireless communication and cellular communication, the floor plan 2300 would include 40 active antenna tiles 2302, which is less than the 90 to 120 systems required for the combination of wireless routers 2102 and femtocells 2202.

Real-World Example

Figure 24:
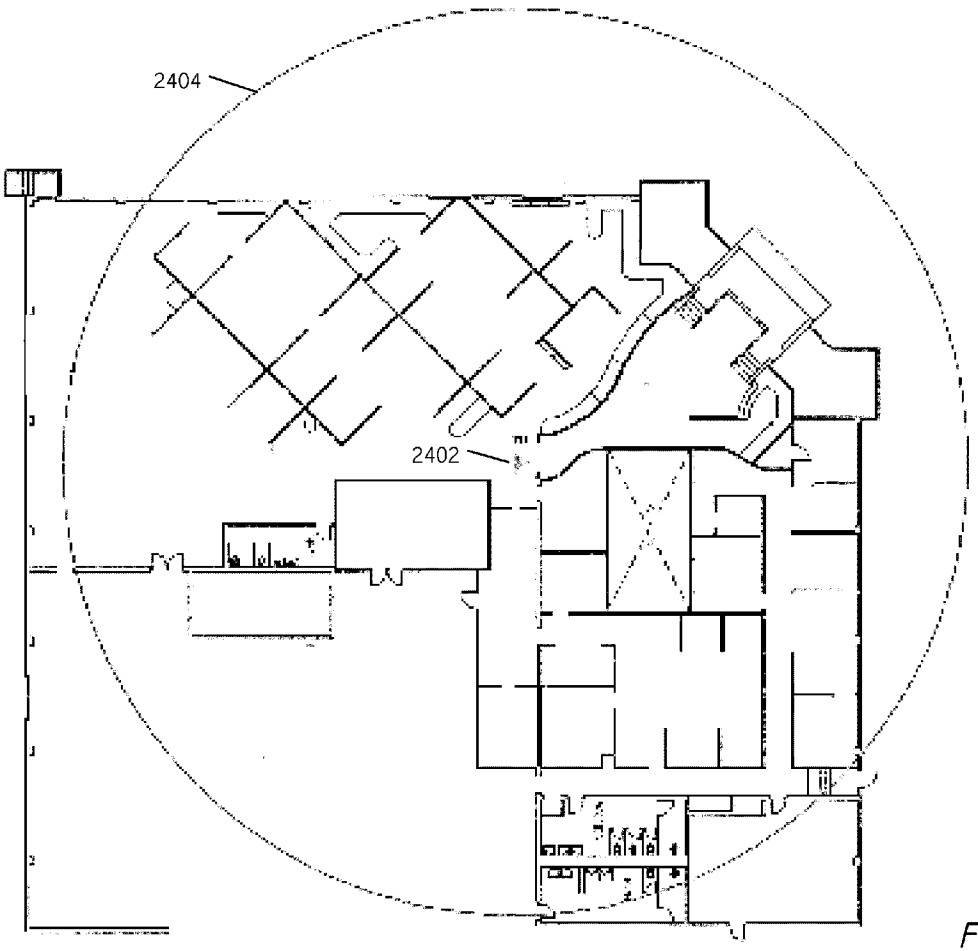
FIG. 24 illustrates the coverage area for a real-world test installation of an active antenna ceiling tile.

FIG. 24 illustrates the coverage area for a real-world test installation of an active antenna ceiling tile 2402. The test was performed in a building of approximately 80,000 $ft^2$ located at 6711 East Washington Street, Los Angeles, Calif. 90040. The active antenna ceiling tile 2402 was installed with a one tile ground plane (2 feet by 2 feet) adjacent and in electrical communication with the active antenna ceiling tile 2402. Additional metallic ceiling tiles within a 10 to 20 feet range also existed in the ceiling, which can affect signal range due to the meandering effect of the signal along the tiles and tilt change of the radiation. However, these additional metallic ceiling tiles were not electrically connected to the ground plane or active antenna ceiling tile 2402. An Apple 3GS iPhone™ was used to test the cellular connection with and without the active antenna ceiling tile 2402. At the test location, the phone displayed 4 signal strength bars on the roof. However, throughout most of the floor of the building 2400, the phone displayed between 1 and 2 bars of signal strength.

An active antenna ceiling tile 2402 was installed and connected to an amplifier, which was then connected to a donor antenna on the roof of the test building. The active antenna ceiling tile 2402 used in the test included two log periodic antennas with a frequency range of 850-6500 MHz and a gain of 6 dBi. The amplifier used was a Wilson SOHO 60, P/N 801245. The donor antenna used was a PowerMax™, P/N 295-PW. Although a splitter was not used during the test, it should be understood that in some cases a splitter may be used to divide the signal energy between the antennas.

With the active antenna ceiling tile 2402 in place, the phone consistently displayed 4 signal bars within the area of the circle 2404. The radius of the circle 2404 is approximately 75 feet resulting in a coverage area of over 17,000 square feet.

As previously mentioned, the active antenna ceiling tile 2402 was installed with a minimal ground plane (a single 2 feet by 2 feet tile). It is expected that a larger ground plane would provide improved results. For instance, as illustrated in FIG. 20, the installation of the metallic ground plane would cause the signal from the active antenna ceiling tile 2402 to meander along the ceiling resulting in larger coverage area. In certain embodiments, the expanded coverage may be up to 100 feet resulting in a coverage area of over 30,000 $ft^2$.

Example Wireless Communication Installation Process

Figure 25:
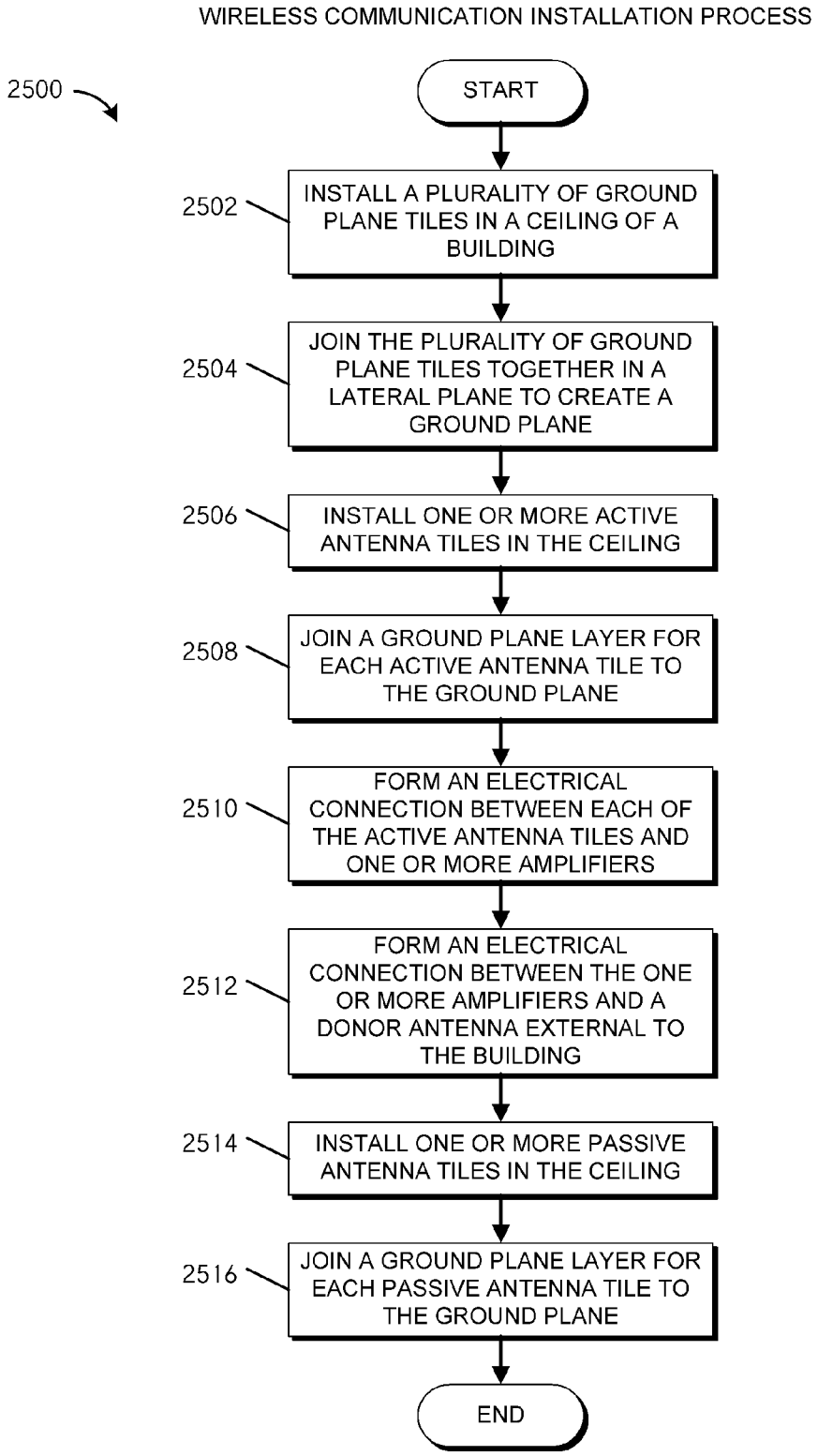
FIG. 25 presents a flowchart of an embodiment of a wireless communication installation process.

FIG. 25 presents a flowchart of an embodiment of a wireless communication installation process 2500. It should be noted that the same installation process 2500 may be used for installing cellular communication antenna tiles or hybrid antenna tiles that can be used for wireless and cellular communication. Further the process 2500 is not limited by the type of antennas used, but is applicable to any system that installs antenna tiles into a ceiling with a ground plane. Moreover, in certain embodiments, the process 2500 may be modified to install antenna tiles with a ground plane into walls or floors of a building. Although the process 2500 will be described with respect to a particular order, it should be understood that the process 2500 is not limited as such and any implied order is only to simplify discussion.

The process 2500 begins at block 2505 where a plurality of ground plane tiles 1002 are installed in a ceiling of a building. The ground plane tiles 1002 may be installed by inserting the tiles into a ceiling support structure configured to hold ceiling tiles. Alternatively, the block 2502 may include installing a ground plane above an existing ceiling, which may or may not comprise ceiling tiles. For example, the ground plane may be created from a thin metallic or conducting sheet (e.g., a layer of aluminum) that may be layered above an existing ceiling. Advantageously, in certain embodiments, by installing a ground plane above an existing ceiling, embodiments of the present disclosure may be used to retrofit existing buildings without replacing the existing ceiling.

At block 2504, the plurality of ground plane tiles 1002 may be joined together in a lateral plane to create a ground plane 1007. The ground plane tiles 1002 may be joined using staples, an adhesive, a clamp, or any other conductive joining mechanism. In certain embodiments, the block 2504 may be omitted. For example, as stated above, the ground plane may be created from a single large sheet that is sized to cover an entire ceiling or a large portion of a ceiling. In certain embodiments, the ground plane may include holes and/or spaces between tiles to accommodate ceiling structures that require access to the floor or room (e.g., HVAC vents, sprinklers, etc.).

At block 2506, one or more active antenna tiles (e.g., active antenna tiles 1200, 1902, 1906) are installed in the ceiling. For each of the one or more active antenna tiles, a ground plane layer of the active antenna tile is joined at block 2508 to the ground plane created at the block 2506. Generally, the same joining method used at the block 2504 is used at the block 2508. However, in some embodiment a different joining method may be used. For example, staples may be used as the joining mechanism at the block 2504 while clamps may be used as the joining mechanism at the block 2508. Further, in some cases a joining mechanism may not be necessary at the block 2504, such as when the ground plane consists of a sheet of conductive material layered above the ceiling tiles, but a joining mechanism may be used to join the active antenna tiles to the ground plane.

At block 2510, an electrical connection is formed between each of the one or more active antenna tiles and one or more amplifiers. As previously described, the one or more amplifiers may be bidirectional amplifiers. Each active antenna tile may be connected to a separate amplifier. Alternatively, some active antenna tiles may be connected to the same amplifier. The block 2510 may further include electrically connecting at least some of the active antenna tile to additional communications equipment in the building. For example, the active antenna tiles may be in communication with a switch, a hub, a router, a fiber optic headend, one or more filters, and any other equipment that may be used as part of an intranet, an external network, a cellular network, or other communications network. Further, in embodiments where the active antenna tile does not include a power divider or splitter, the active antenna tile may be in electrical communication with a power divider. It should be understood that the active antenna tiles may only be in direct communication with a single element (e.g., an amplifier, splitter, power divider, etc.) and may indirectly communicate with other elements through the single element or other elements.

At block 2512, an electrical connection between the one or more amplifiers and a donor antenna is formed. Generally, the donor antenna is external to the building. However, in some embodiments, the donor antenna may be at least partially inside the building, but positioned in a location to access a cellular or wireless network external to the building. In some embodiments, one or more intermediary devices may exist between the one or more amplifiers and the donor antenna, such as a splitter. In some embodiments, the block 2512 may be omitted. For example, in some cases, a wired connection to the building for a communications service (e.g., access to the Internet through a wired connection to an Internet Service Provider or ISP) may exist. In such cases, the active antenna tiles and/or amplifiers may be electrically connected to the communications service. For example, the amplifier may connect to a router that then connects to an Ethernet port that leads to one or more pieces of equipment for accessing the Internet via an ISP.

At block 2514, one or more passive antenna tiles are installed in the ceiling. For each of the one or more passive antenna tiles, a ground plane layer of the passive antenna tile is joined at block 2516 to the ground plane created at the block 2506. Generally, the same joining method used at the block 2508 is used at the block 2514. However, in some embodiments, a different joining method or mechanism may be used. In some embodiments, the passive antenna tiles may be installed in a wall. In some such cases, the block 2516 may be omitted. Further, in some embodiments, both the blocks 2514 and 2516 may be omitted.

Example Manufacturing System

Figure 27:
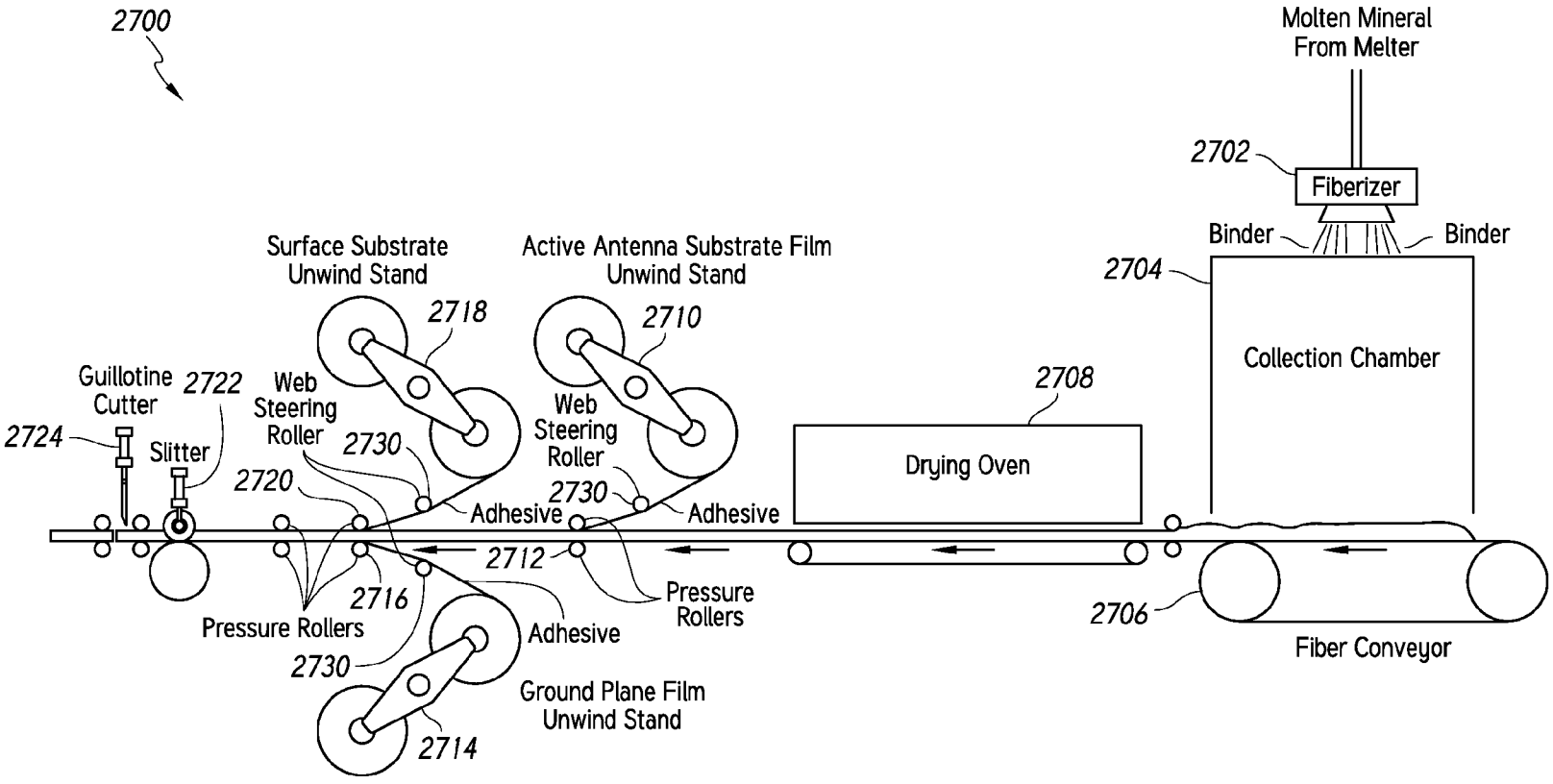
FIG. 27 illustrates an embodiment of a manufacturing system that may be used to manufacture an active antenna ceiling tile.

FIG. 27 illustrates an embodiment of a manufacturing system 2700 that may be used to manufacture an active antenna ceiling tile. An example manufacturing process using the manufacturing system 2700 will now be described. In certain embodiments, the process begins with molten mineral being provided to a fiberizer that can create fibers of varying diameter from the molten mineral. The molten mineral may include any type of mineral that may be used to create mineral tiles. Further, the molten mineral may be received from a melter configured to melt solid mineral.

The fibers from the fiberizer 2702 may be provided to a collection chamber 2704. In some cases, binder may be added at the top of the collection chamber 2704 to give the fiber or wool blanket greater integrity to improve processing. The wool blanket may be collected onto a moving conveyor 2706 that moves the wool blanket to a drying oven 2708 where the binder is cured.

After the wool blanket is cured, it is moved to a substrate station where an active antenna substrate film is drawn from an active antenna substrate film unwind stand 2710. The active antenna substrate film may be created using any type of process for generating substrate films for use with electronic devices. Further, the active antenna substrate film includes the elements for the desired antenna, which may be deposited or etched onto the substrate as part of the substrate manufacturing process. Further, in some embodiments, a power divider may be deposited or etched onto the substrate. For example, the active antenna or antennas and/or the power divider may be deposited onto the substrate or a thin film layered on the substrate as part of a copper deposition process. After the lamination of layering of the active antenna elements, a power connector may be inserted into the film. This process may include creating a pilot hold in the mineral tile through the surface of the film. The process of adding the antennas and power connector may occur as the active antenna substrate is added or may occur after the tiles are separated by, for example, the guillotine cutter 2724. The active antenna substrate film may be wound around a spool for application during a manufacturing process. In certain embodiments, the active antenna substrate film may include indexing marks on the edges of the film to facilitate positioning the substrate on the blanket. Further the indexing marks may be used to help with cutting the blanket into individual tiles.

Adhesive may be applied to the backside of the active antenna substrate film. Pressure rollers 2712 may then fix the substrate to the top side of the blanket. Alternatively, or in addition other, binding mechanism may be used. For example, staples may be used to bind the layers of the active antenna tiles.

At a ground plane film unwind stand 2714, a ground plane or shield is unwound and applied to the blanket. As with the active antenna substrate film, the ground plane film may be applied with an adhesive. Further, pressure rollers 2716 may help apply the ground plane to the blanket.

At a surface substrate unwind stand 2718, a surface substrate layer is applied atop the active antenna substrate film. As with the previous layers, an adhesive may be applied and pressure rollers 2720 may be used to help apply the surface substrate to the blanket. In some embodiments, multiple layers may be applied at one or more of the unwind stations so as to obtain a desired thickness. In some embodiments, web steering rollers 2730 may facilitate the movement and application of the layers from the unwind stands 2710, 2714, and 2718.

Slitters 2722 may be used to cut the blanket in a lateral direction. Crosscut devices, such as the guillotine cutter 2724 may be used to cut the blanket in the longitude direction to the final length. In some embodiments, alternative or additional cutting devices may be used, such as water jets or lasers.

A connector, such as an SMT connector may be applied to the tile before or after the individual tiles are cut to size. Further, the manufacturing system 2700 may be modified to create ground plane tiles by, for example, omitting the application of the active antenna substrate. In certain embodiments, the active antenna substrate film unwind stand 2710 may be omitted. In other embodiments, the active antenna substrate film unwind stand 2710 may be included, but may be deactivated or skipped when creating a ground plane tile.

It should be understood that the manufacturing system 2700 and the manufacturing process described with respect to the manufacturing system 2700 is one example system and process for creating active antenna tiles, and ground plane tiles. Other manufacturing systems and process are possible.

Additional Embodiments

Although primarily described with respect to a ceiling structure, embodiments disclosed herein may, in some cases, be applied to floors and/or walls. For example, an active antenna ceiling tile and ground plane may be constructed as part of a wall in a building. The ground plane may reduce multipath interference from metallic structures that may exist between rooms in a building. Further, active antenna tiles that are in electrical communication with wireless routers may be placed in walls to improve network communication. In some embodiments, the ground plane may encompass at least a portion of a ceiling and a wall. Further, active antenna tiles may be placed in both the ceiling and wall in some cases.

Figure 26:
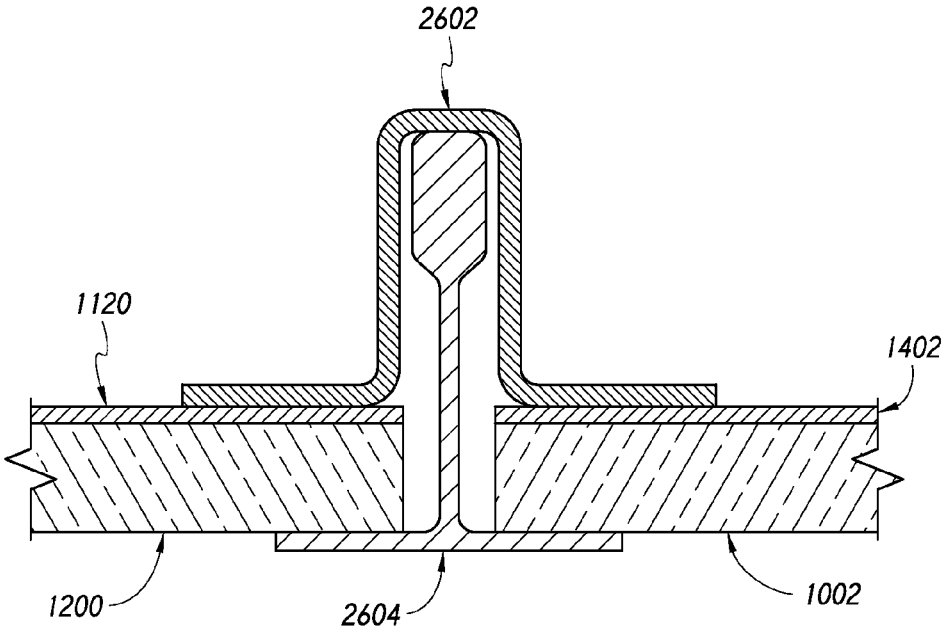
FIG. 26 illustrates an embodiment of a clamp that may be used to join two ceiling tiles.

As previously stated, in some embodiments, the antenna ceiling tiles (e.g., active antenna ceiling tiles 1200, ground plane tiles 1002, passive antenna tiles 1904) may be joined using a clamp. FIG. 26 illustrates one embodiment of a clamp 2602 that may be used to join two ceiling tiles. In the example illustrated in FIG. 26, the clamp 2602 is used to join an active antenna ceiling tile 1200 with a ground plane tile 1002. An electrical connection is formed by contacting, with a conducting portion of the clamp 2602, the ground plane layer 1120 of the active antenna ceiling tile 1200 and the ground plane layer 1402 of the ground plane tile 1002. The ceiling tiles may be placed on a support structure (e.g., a T-Bar support 2604). The clamp 2602 may then be used to complete an electrical connection between the ceiling tiles as well as providing additional support to complete the ceiling tiles in place. In some embodiments, the clamp 2602 may be a spring loaded metallic hold down clamp. The clamp 2602 may assert pressure atop each tile to facilitate keeping the tiles in place. Further, the clamp 2602 may grip the T-Bar support 2604 to maintain its position.

TERMINOLOGY

The above description is provided to enable any person skilled in the art to make or use embodiments within the scope of the appended claims. Various modifications to these aspects will be readily apparent to those skilled in the art, and the generic principles defined herein may be applied to other aspects without departing from the scope of the disclosure. Thus, the present disclosure is not intended to be limited to the aspects shown herein but is to be accorded the widest scope consistent with the principles and novel features disclosed herein.

Depending on the embodiment, certain acts, events, or functions of any of the algorithms, methods, or processes described herein can be performed in a different sequence, can be added, merged, or left out altogether (e.g., not all described acts or events are necessary for the practice of the algorithms). Moreover, in certain embodiments, acts or events can be performed concurrently rather than sequentially. For example, blocks 2506 and 2514 may be performed in reverse order or at least partially in parallel.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. In addition, the articles "a" and "an" are to be construed to mean "one or more" or "at least one" unless specified otherwise.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

While the above detailed description has shown, described, and pointed out novel features as applied to various embodiments, it will be understood that various omissions, substitutions, and changes in the form and details of the devices or algorithms illustrated can be made without departing from the spirit of the disclosure. Thus, nothing in the foregoing description is intended to imply that any particular feature, characteristic, step, operation, module, or block is necessary or indispensable. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. An active antenna ceiling assembly comprising:

a ground plane structure comprising a plurality of ground plane tiles without an antenna layer, wherein each ground plane tile comprises an electromagnetically reflective layer; and an active antenna tile having the same approximate area as a ground plane tile from the plurality of ground plane tiles, the active antenna tile comprising:

a first dielectric layer;

an antenna layer comprising a number of antennas configured to receive and transmit radio frequency (RF) signals, the antenna layer disposed on the first dielectric layer; and a ground plane layer disposed above the antenna layer and in electrical communication with the ground plane structure, wherein a ratio between the number of ground plane tiles and the number of active antenna tiles is greater than or equal to 8 to 1;

wherein the active antenna tile further comprises a second dielectric layer disposed between the antenna layer and the first ground plane layer; and wherein the active antenna tile further comprises a bidirectional power divider in electrical communication with at least two antennas of the number of antennas.

2. The active antenna ceiling assembly of claim 1, wherein each ground plane tile further comprises a dielectric layer.

3. The active antenna ceiling assembly of claim 1, wherein the ground plane layer comprises an electromagnetically reflective layer.

4. The active antenna ceiling assembly of claim 1, wherein the bidirectional power divider is configured to divide a RF signal received from a donor antenna among the at least two antennas.

5. The active antenna ceiling assembly of claim 1, wherein the bidirectional power divider is configured to combine RF signals received from the at least two antennas.

6. The active antenna ceiling assembly of claim 1, wherein the active antenna tile further comprises a router and wherein the number of antennas are configured to serve as wireless antennas for the router.

7. The active antenna ceiling assembly of claim 1, wherein the ground plane structure is coextensive with a ceiling of a floor in a building.

8. The active antenna ceiling assembly of claim 1, wherein the ground plane structure further comprises one or more windows without ground plane tiles for heating, ventilation, and air conditioning (HVAC) access.

9. The active antenna ceiling assembly of claim 1, further comprising a passive antenna tile comprising a number of passive antennas.

10. The active antenna ceiling assembly of claim 1, further comprising a bidirectional amplifier configured to communicate an RF signal between the active antenna tile and a donor antenna.

11. The active antenna ceiling assembly of claim 1, further comprising a number of electrically conductive staples configured to combine the plurality of ground plane tiles together to form the ground plane structure.

12. The active antenna ceiling assembly of claim 1, further comprising a number of clamps configured to combine the plurality of ground plane tiles together to form the ground plane structure.

13. The active antenna ceiling assembly of claim 1, wherein the active antenna ceiling assembly is configured for a building with a floor plan of at least 50,000 $ft^2$ for at least one floor in the building.

14. A method of installing a wireless communication system in a building, the method comprising:

installing a plurality of ground plane tiles without an antenna layer in a ceiling of a building, the ground plane tiles installed beneath a set of structures between the ceiling and a floor above the ceiling, wherein the ground plane tiles are configured to be electromagnetically reflective;

joining the plurality of ground plane tiles together in a lateral plane using a conductive joining element to create a ground plane;

installing an active antenna tile in the ceiling, wherein the active antenna tile has the same approximate area as a ground plane tile from the plurality of ground plane tiles and wherein a ground plane layer of the active antenna tile is positioned within the lateral plane of the plurality of ground plane tiles; and joining the ground plane layer of the active antenna tile to at least one of the plurality of ground plane tiles thereby including the ground plane layer of the active antenna layer as part of the ground plane, wherein a ratio between the number of ground plane tiles and the number of active antenna tiles is greater than or equal to 8 to 1; and electrically connecting the active antenna tile to at least one of a bidirectional power divider, a router, a bidirectional amplifier, and a donor antenna.

15. The method of claim 14, wherein the ground plane is substantially coextensive with the ceiling.

16. The method of claim 14, further comprising: installing a passive antenna tile in the ceiling, wherein a ground plane layer of the passive antenna tile is positioned within the lateral plane of the plurality of ground plane tiles; and joining the ground plane layer of the passive antenna tile to at least one of the plurality of ground plane tiles thereby including the ground plane layer of the passive antenna tile as part of the ground plane.

17. The method of claim 14, wherein the conductive joining element comprises at least one of a conductive staple, a conductive hold down clamp, a conductive frame.

18. An active antenna ceiling assembly comprising:

a ground plane structure comprising a plurality of ground plane tiles without an antenna layer, wherein each ground plane tile comprises an electromagnetically reflective layer; and an active antenna tile having the same approximate area as a ground plane tile from the plurality of ground plane tiles, the active antenna tile comprising:

a first dielectric layer;

an antenna layer comprising a number of antennas configured to receive and transmit radio frequency (RF) signals, the antenna layer disposed on the first dielectric layer; and a ground plane layer disposed above the antenna layer and in electrical communication with the ground plane structure, wherein a ratio between the number of ground plane tiles and the number of active antenna tiles is greater than or equal to 8 to 1;

wherein the active antenna tile further comprises a second dielectric layer disposed between the antenna layer and the first ground plane layer; and wherein the active antenna tile further comprises a router and wherein the number of antennas are configured to serve as wireless antennas for the router.

19. An active antenna ceiling assembly comprising:

a ground plane structure comprising a plurality of ground plane tiles without an antenna layer, wherein each ground plane tile comprises an electromagnetically reflective layer; and an active antenna tile having the same approximate area as a ground plane tile from the plurality of ground plane tiles, the active antenna tile comprising:

a first dielectric layer;

an antenna layer comprising a number of antennas configured to receive and transmit radio frequency (RF) signals, the antenna layer disposed on the first dielectric layer; and a ground plane layer disposed above the antenna layer and in electrical communication with the ground plane structure, wherein a ratio between the number of ground plane tiles and the number of active antenna tiles is greater than or equal to 8 to 1;

wherein the active antenna tile further comprises a second dielectric layer disposed between the antenna layer and the first ground plane layer; and wherein the ground plane structure further comprises one or more windows without ground plane tiles for heating, ventilation, and air conditioning (HVAC) access.

20. An active antenna ceiling assembly comprising:

a ground plane structure comprising a plurality of ground plane tiles without an antenna layer, wherein each ground plane tile comprises an electromagnetically reflective layer;

an active antenna tile having the same approximate area as a ground plane tile from the plurality of ground plane tiles, the active antenna tile comprising:

a first dielectric layer;

an antenna layer comprising a number of antennas configured to receive and transmit radio frequency (RF) signals, the antenna layer disposed on the first dielectric layer; and a ground plane layer disposed above the antenna layer and in electrical communication with the ground plane structure, wherein a ratio between the number of ground plane tiles and the number of active antenna tiles is greater than or equal to 8 to 1;

wherein the active antenna tile further comprises a second dielectric layer disposed between the antenna layer and the first ground plane layer; and a bidirectional amplifier configured to communicate an RF signal between the active antenna tile and a donor antenna.

* * * * *